US007192118B2

(12) United States Patent
Kojima et al.

(10) Patent No.: US 7,192,118 B2
(45) Date of Patent: Mar. 20, 2007

(54) DROPLET EJECTING HEAD AND DROPLET EJECTING APPARATUS

(75) Inventors: Ryuichi Kojima, Ebina (JP); Masakazu Okuda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 170 days.

(21) Appl. No.: 10/715,499

(22) Filed: Nov. 19, 2003

(65) Prior Publication Data

US 2004/0150693 A1 Aug. 5, 2004

(30) Foreign Application Priority Data

Nov. 22, 2002 (JP) ..... 2002-339265

(51) Int. Cl.
*B41J 2/15* (2006.01)

(52) U.S. Cl. ..... 347/40; 347/57; 347/68; 347/10

(58) Field of Classification Search ..... 347/40, 347/57, 10, 68
See application file for complete search history.

(56) References Cited

U.S. PATENT DOCUMENTS 6,595,614 B2 * 7/2003 Morikawa et al. ..... 347/15
6,742,866 B2 * 6/2004 Anderson et al. ..... 347/40
6,923,521 B2 * 8/2005 Bates et al. ..... 347/40

* cited by examiner

*Primary Examiner*—Lamson Nguyen
(74) *Attorney, Agent, or Firm*—Oliff & Berridge, PLC

(57) ABSTRACT

When ejectors (nozzles) are viewed in order in a sub-scanning direction, the ejectors are arranged so that positions of the ejectors in a main scanning direction alternate in an offsetting manner. When formed dots are viewed along the sub-scanning direction, sizes of the dots are changed at random. Accordingly, density unevenness is decreased, the ejectors can be arranged in high density, and an image can be recorded at high speed. That is, the invention provides a droplet ejecting head in which density unevenness which tends to be generated in a head having a matrix-like nozzle arrangement can be decreased without decreasing recording speed and thus high-speed recording is made compatible with high-quality recording. The invention also provides a droplet ejecting apparatus which is provided with the droplet ejecting head.

14 Claims, 29 Drawing Sheets

DROPLET EJECTING HEAD AND DROPLET EJECTING APPARATUS

CROSS-REFERENCE TO RELATED APPLICATION

This application claims priority under 35 USC 119 from Japanese Patent Application No. 2002-339265, the disclosures of which are incorporated by reference herein.

BACKGROUND OF THE INVENTION

1. Field of the Invention

The present invention relates to a droplet ejecting head and a droplet ejecting apparatus, in particular relates to the droplet ejecting head and the droplet ejecting apparatus, which eject a droplet to record characters and images on a recording medium or form a fine pattern, a thin film, and the like on a substrate.

2. Description of the Related Art

A method of ejecting an ink droplet is generally well known, which method including the steps of: generating a pressure wave (acoustic wave) by using means for generating pressure such as a piezoelectric actuator to liquid filled in a pressure generating chamber; and ejecting a liquid droplet from a nozzle communicated with the pressure generating chamber, by the pressure wave. Particularly, inkjet recording apparatuses which eject an ink droplet to record characters and images on a sheet of recording paper have become widesperad (for example, patent reference 1 and patent reference 2 described below). In recent years, inkjet recording apparatus can record extremely high-quality images, as a result of a decrease in an ink droplet volume and use of low-density ink.

Further, in recent years, several attempts have been made to utilize a droplet ejecting apparatus adopting the above-described droplet ejecting method in an industrial environment. Representative examples of such industrial utilization of a droplet ejecting apparatus include:

(a) forming lead patterns or transistors by ejecting an electrically conductive polymer solution on a substrate;
(b) forming an EL (electroluminescent) display panel by ejecting an organic EL solution on a substrate;
(c) forming a bump for electrical mounting by ejecting melted solder on a board;
(d) forming a three-dimensional object by laminating and curing a droplet of UV curable resin and the like on a substrate; and
(e) forming an organic thin film by ejecting a solution of an organic material (e.g., a solution of resist) on a substrate.

Thus, the application of a droplet ejecting apparatus is not limited to use for recording images. The droplet ejecting apparatus may be utilized in a variety of fields and it is expected that the field to which the droplet ejecting apparatus can be applied will further be extended in future.

Hereinafter an object on which a droplet is ejected with the droplet ejecting head will be referred to as "recording medium" and a pattern of dots which is obtained on a recording medium by depositing a droplet on the recording medium will be referred to as "image" or "recording image". Therefore, "recording medium" in the following description includes not only recording paper and an OHP sheet but also a substrate as described above. "Image" in the following description includes not only general images such as characters, drawings, and photographs but also the above-mentioned lead pattern, three-dimensional object, and an organic thin film.

FIG. 24 is a sectional view showing an example of a droplet ejecting mechanism (an ejector) in a droplet ejecting apparatus well known in the patent references 1 and 2 described above. A pressure generating chamber 14 is coupled to a nozzle 16 for ejecting a droplet and a feed channel 20 for introducing liquid from a liquid tank (not shown) through a common channel 18 to the pressure generating chamber 14. A diaphragm 22 is provided on a bottom surface of the pressure generating chamber 14. When a droplet is to be ejected, a pressure wave is generated in the pressure generating chamber 14 by: displacing the diaphragm 22 by using a piezoelectric actuator 24 provided on a side of the diaphragm 22 which is opposite to the pressure generating chamber 14; and generating a change in a volume in the pressure generating chamber 14. A portion of the liquid filled in the pressure generating chamber 14 is injected toward the outside through the nozzle 16 by the pressure wave, to become a droplet 26, which then flies. The flying droplet 26 lands on a recording medium such as recording paper and the dot (image) is formed thereon. The pattern of characters and images is recorded (formed) on the recording medium by repeating the formation of the dot on the basis of image data and the like.

Currently, in the droplet ejecting apparatus as described above, improvement of the recording speed has been a major task. In a droplet ejecting apparatus, the parameter which most significantly affects the recording speed is the number of nozzles. The larger the number of nozzles is, the more the number of dots which can be formed per unit time is increased, and a higher recording speed is resulted. Therefore, a conventional droplet ejecting apparatus generally employs a multi-nozzle type droplet ejecting head (linear nozzle arrangement head) in which the plurality of ejectors are coupled to one another.

FIG. 25 shows a linear nozzle arrangement head 32 as an example of the multi-nozzle type droplet ejecting head. In the linear nozzle arrangement head 32, the liquid tank (not shown) is coupled to a common channel 36 through a liquid feed aperture 34 and the common channel 36 is coupled to a plurality of ejectors 38.

However, in the structure of FIG. 25 in which the ejectors 38 are arranged in one-dimensional manner (linearly), the number of ejectors cannot be increased so much (about 100 ejectors is the upper limit, normally).

Thus, there have been proposed several types of droplet ejecting head in which the number of ejectors is increased by arranging the ejectors in the form of a two-dimensional matrix (which type of droplet ejecting head will be referred to as "matrix-arrangement head" hereinafter) (refer to patent reference 3, patent reference 4 described below).

FIGS. 26A and 27A each show an example of a basic structure of the conventional matrix-arrangement head.

In the matrix-arrangement heads 42 and 52, a plurality of ejectors 44 are coupled to one another by each common channel 46, and a plurality of the common channels 46 are linked by a second common channel 48. In the matrix-arrangement head 42 shown in FIG. 26A, the common channel 46 is arranged along a main scanning direction of the head (indicated by an arrow M) and the second common channel 48 is arranged along a direction orthogonal to the main scanning direction (i.e., a sub-scanning direction, indicated by an arrow S). Each of ejectors 44A to 44H coupled to the same common channel 46 is arranged to be shifted by Pn in the sub-scanning direction. Dots 50 having a pitch Pn as shown in FIG. 26B are formed by ejecting a droplet from each ejector, while controlling ejection timing of each ejector in the process of scanning the head in the main scanning direction.

In the matrix-arrangement head 52 shown in FIG. 27A, the common channel 46 is arranged along the sub-scanning direction and the second common channel 48 is arranged along the main scanning direction. In this case, the ejectors adjacent to each other in the main scanning direction are also arranged to be each shifted by Pn in the sub-scanning direction. The dots 50 having the pitch Pn as shown in FIG. 27B are formed by ejecting a droplet from each ejector, while controlling the ejection timing of each ejector in the process of scanning the head in the main scanning direction.

In the matrix-arrangement head having the above-mentioned structure, it is easy to increase the number of ejectors, which is very advantageous in performing image recording at high speed. For example, in the matrix-arrangement head 42 shown in FIG. 26A, the 260 ejectors can be arranged by setting the number of common channels 46 to 26 and coupling ten ejectors 44 to each common channel 46 (In FIG. 26A, the number of common channels 46 is set to 8, the number of ejectors 44 per one common channel is set to 8, and only 64 ejectors 44 are shown, as a whole).

However, in the conventional matrix-arrangement head as described above, while the matrix-arrangement head has the advantage of high-speed recording, there is a problem that high uniformity of recording result is not easily obtained. Specifically, there is a problem that cyclic density unevenness (unevenness of a dot diameter) is easily generated in the direction (sub-scanning direction) orthogonal to the main direction of the head, which results in large loss of the uniformity of the recording result.

There are various reasons why such density unevenness is easily generated in the matrix-arrangement head. In particular, a change in ejection characteristics of the ejector (for example, droplet volume and ejecting speed of droplet) depending on a position of the ejector on a nozzle surface often results in the density unevenness.

In general, it is impossible to manufacture a head which is free of variations in the ejection characteristics of the ejector, and the farther the two ejectors are physically separated from each other, the larger the magnitude of variations in the ejection characteristics of the ejector. For example, in the case where the head is manufactured by laminating a member such as the substrate, deviation in a rotational direction among the laminated members results in the variations in the ejection characteristics among the ejectors. FIGS. 28A to 28D show examples of a case in which a positional deviation has been generated between the pressure generating chamber and the piezoelectric actuator. In the example shown in FIG. 28A, the pressure generating chamber 14 is formed by sandwiching a pressure generating chamber plate 54, in which a hole 56 is formed, from both sides with a diaphragm 58 and a nozzle plate 60. The pressure generating chamber 14 is disposed on one side of the diaphragm 58 and a piezoelectric actuator plate 62 is disposed on the other side of the diaphragm 58. A piezoelectric actuator 64 of the piezoelectric actuator plate 62 vibrates the diaphragm 58 to increase/decrease the volume of the pressure generating chamber 14 (see FIG. 28C), whereby a droplet is ejected from the nozzle (not shown). Accordingly, it is preferable that relative positions of the pressure generating chamber 14 with respect to the diaphragm 58 are the same in all the pressure generating chambers 14.

However, in practice, as shown in FIG. 28B, a deviation in the rotational direction may be generated between the pressure generating chamber plate 54 and the piezoelectric actuator plate 62, when the head is viewed from a direction perpendicular to the plate. As can be seen from FIG. 28B, the more downstream in the direction of the arrow S the pressure generating chamber 14 is located, the less area of the piezoelectric actuator 64 overlaps the pressure generating chamber 14. When the pressure generating chamber 14A at one end in the arrow S direction is compared with the pressure generating chamber 14B at the other end, the area of the pressure generating chamber 14B overlapped by the corresponding piezoelectric actuator 64 is less than the area of the pressure generating chamber 14A overlapped by the corresponding piezoelectric actuator 64.

Both of FIGS. 28C and 28D show action of the piezoelectric actuator 64 in the pressure generating chambers 14A and 14B. The diaphragm 58 is significantly deformed in the pressure generating chamber 14A in which the area thereof overlapped by the piezoelectric actuator 64 is relatively large. On the other hand, in the pressure generating chamber 14B in which the area thereof overlapped by the piezoelectric actuator 64 is relatively small, a portion of the piezoelectric actuator 64 also overlaps the pressure generating chamber plate 54 which is rigid (see a portion indicated by a circular two-dot chain line C1) and the deformation of the diaphragm 58 is constrained. That is, the amount of overlap between the pressure generating chamber 14 and the piezoelectric actuator 64 has an influence on the deformation of the diaphragm 58 and thus changes the ejection characteristics of the ejector. In the structure shown in FIG. 28B, the amount of overlap between the pressure generating chamber 14 and the piezoelectric actuator 64 is linearly changed according to the line of the ejectors. Therefore, the difference in the ejection characteristics between the ejectors is changed depending on a distance, along the line of the ejectors, from a reference position.

In addition to the deviation in the rotational direction, there also exist some factors of generating a difference in the ejection characteristics, depending on a distance along the line of the ejectors from a reference position. For example, positioning accuracy in the forming process of the nozzle is one of the factors. In order to eliminate variations in the ejection characteristics, it is necessary to accurately position the nozzle relative to the ejector in the forming process of the nozzle. The factors of the positioning accuracy include a difference in a scale between a machining apparatus and the matrix-arrangement head and the deviation in the rotational direction of the machining apparatus and the matrix-arrangement head. When such deviations are generated, the deviation of a nozzle position relative to the ejector is increased as the distance along the line of the ejectors increases, which results in a change in the ejection characteristics. Hereinafter, the linear change in ejection characteristics depending on the position of the ejector will be referred to as "linear ejection characteristics distribution."

In the matrix-arrangement head, since the ejectors are arranged in the main scanning direction, as well, the linear ejection characteristics distribution may also be generated in the main scanning direction. When the recording is performed with the matrix-arrangement head having the linear ejection characteristics distribution in the main scanning direction, a change in the dot diameter having a cycle n is generated in the line of the recorded dots, as shown in FIGS. 26B and 27B. That is to say, the density unevenness having the cycle n in the sub-scanning direction is generated in the recording result.

In a general matrix-arrangement head, in order to realize recording of the resolution in a range from about 150 to about 600 dpi (dots per inch) in the sub-scanning direction, a nozzle pitch Pn ranges from 42.3 μm to 169.3 μm. This arrangement is generally realized with a matrix-nozzle arrangement whose n value is in a range of 4 to 20, approximately. However, in this arrangement, n tends to be increased in order to realize the narrower nozzle pitch. As a result, the cycle of the density unevenness is in a range of 0.42 to 3.4 mm, approximately, in practice. In other words, the density unevenness is generated with a spatial frequency in a range of 0.3 to 2.4 lines/mm.

FIG. 29 is a graph showing human visual sensitivity for density unevenness, in which graph the horizontal axis indicates the spatial frequency. It is found from FIG. 29 that, when the spatial frequency of the density unevenness is not more than 4 lines/mm, the human visual sensitivity for the density unevenness is increased and thus the density unevenness is easily perceived. In particular, when the spatial frequency of the density unevenness is not more than 3 lines/mm, density unevenness is very easily perceived. For the spatial frequency not more than 1 line/mm, there are two different data, i.e. the data that the sensitivity is decreased (broken line) and the data that the sensitivity is not decreased (solid line). According to experimental results by the inventors, the solid line represents the fact observed in practice better.

With reference to the human visual characteristics as described above, it is understood that the density unevenness of the spatial frequency ranging from 0.3 to 2.4 lines/mm which is generated in the conventional matrix-arrangement head is the one which is very easily perceived by human eyes and thus is likely to significantly mar the quality of the recording result. In order make the density unevenness less recognizable, it is necessary to set the spatial frequency of the density unevenness no less than 4 lines/mm or so, more preferably no less than 10 lines/mm or so. However, in the conventional multi-nozzle arrangement head, it is difficult to set the spatial frequency of the density unevenness in the above-described range. That is, highly uniform recording cannot be achieved with the conventional multi-nozzle arrangement head.

[Patent Reference 1]
Japanese Patent Publication (JP-B) No. 53-12138

[Patent Reference 2]
Japanese Patent Application Laid-Open (JP-A) No. 10-193587

[Patent Reference 3]
Japanese Patent Application Laid-Open (JP-A) No. 1-208146

[Patent Reference 4]
Japanese Patent Application Laid-Open (JP-A) No. 9-156095

SUMMARY OF THE INVENTION

In view of the foregoing, it is an object of the present invention to provide a droplet ejecting head in which density unevenness which tends to be generated in a matrix-like nozzle arrangement head can be decreased without decreasing recording speed and therefore high-speed recording can be compatible with high-quality recording, and a droplet ejecting apparatus which is provided with the droplet ejecting head.

In order to solve the above-mentioned problems, according to a first aspect of the invention, a droplet ejecting head in which a plurality of ejectors for ejecting a droplet are two-dimensionally arranged and the droplet is ejected while the droplet ejecting head is moved in a main scanning direction relative to a recording medium, characterized in that, the ejectors are arranged such that, when dots of the droplets ejected on the recording medium are viewed in a main scanning-orthogonal direction, which is orthogonal to the main scanning direction, the sizes of dot diameters are changed at random.

In the droplet ejecting head according to the first aspect of the invention, when the dots of the droplets, ejected while the droplet ejecting head is relatively moved in the main scanning direction, are viewed in the main scanning-orthogonal direction, which is orthogonal to the main direction, the sizes of the dot diameters are cyclically changed. Specifically, the dot diameter is not constantly increased or decreased in the main scanning-orthogonal direction, and the dots having various sizes are mixed in the direction orthogonal to the main scanning direction. In other words, a cyclic pattern of the dot diameter is intentionally destroyed in the direction orthogonal to the main scanning direction. In a state in which the dots having the various sizes are mixed in the main scanning-orthogonal direction, the droplet ejecting head is relatively moved in the main scanning direction, to record the image on the recording medium. Accordingly, the density unevenness in the main scanning-orthogonal direction is decreased in the recorded image.

Further, according to the first aspect of the invention, even if the ejectors are densely arranged, the density unevenness in the direction orthogonal to the main scanning direction is decreased with no necessity of changing the ejection characteristics of the ejector. Accordingly, highly dense arrangement of ejectors can be made compatible with recording images at a high speed.

According to a second aspect of the invention, a droplet ejecting head in which a plurality of ejectors for ejecting a droplet are two-dimensionally arranged and the droplet is ejected while the droplet ejecting head is moved in a main scanning direction relative to a recording medium, is characterized in that, the ejectors are arranged such that, when the ejectors are viewed in order in the main scanning-orthogonal direction, which is orthogonal to the main scanning direction, positions of the ejectors in the main scanning direction alternate in an offsetting manner.

In the droplet ejecting head according to the second aspect of the invention, when the ejectors are viewed in order in the main scanning-orthogonal direction, which is orthogonal to the main direction, the positions of the ejectors in the main scanning direction alternate an offsetting manner, so that the sizes of the dot diameters, viewed in the main scanning-orthogonal direction, are also changed at random.

Specifically, the dot diameter is not constantly increased or decreased in the main scanning-orthogonal direction, and the dots having various sizes are mixed in the direction orthogonal to the main scanning direction. In other words, the cyclic pattern of the dot diameter is intentionally destroyed in the direction orthogonal to the main scanning direction. In a state in which the dots having the various sizes are mixed in the main scanning-orthogonal direction, the droplet ejecting head is relatively moved in the main scanning direction, to record the image on the recording medium. Accordingly, the density unevenness in the main scanning-orthogonal direction in the recorded image is decreased.

Further, according to the second aspect of the present invention, even if the ejectors are densely arranged, the density unevenness in the direction orthogonal to the main scanning direction is decreased with no necessity of changing the ejection characteristics of the ejector. Accordingly, highly dense arrangement of ejectors can be made compatible with recording images at a high speed.

BRIEF DESCRIPTION OF THE DRAWINGS

FIG. 28A is a longitudinal sectional view in the vicinity of a pressure generating chamber, FIG. 28B is a plan view as seen from a normal direction of the plate. FIG. 28C is a sectional view of the pressure generating chamber in a case where the deviation is relatively small. FIG. 28D is a sectional view of the pressure generating chamber in a case where the deviation is relatively large.

DETAILED DESCRIPTION OF THE INVENTION

With reference to the accompanying drawings, preferred embodiments of the present invention will be described in detail below.

[First Embodiment]

Figure 1:
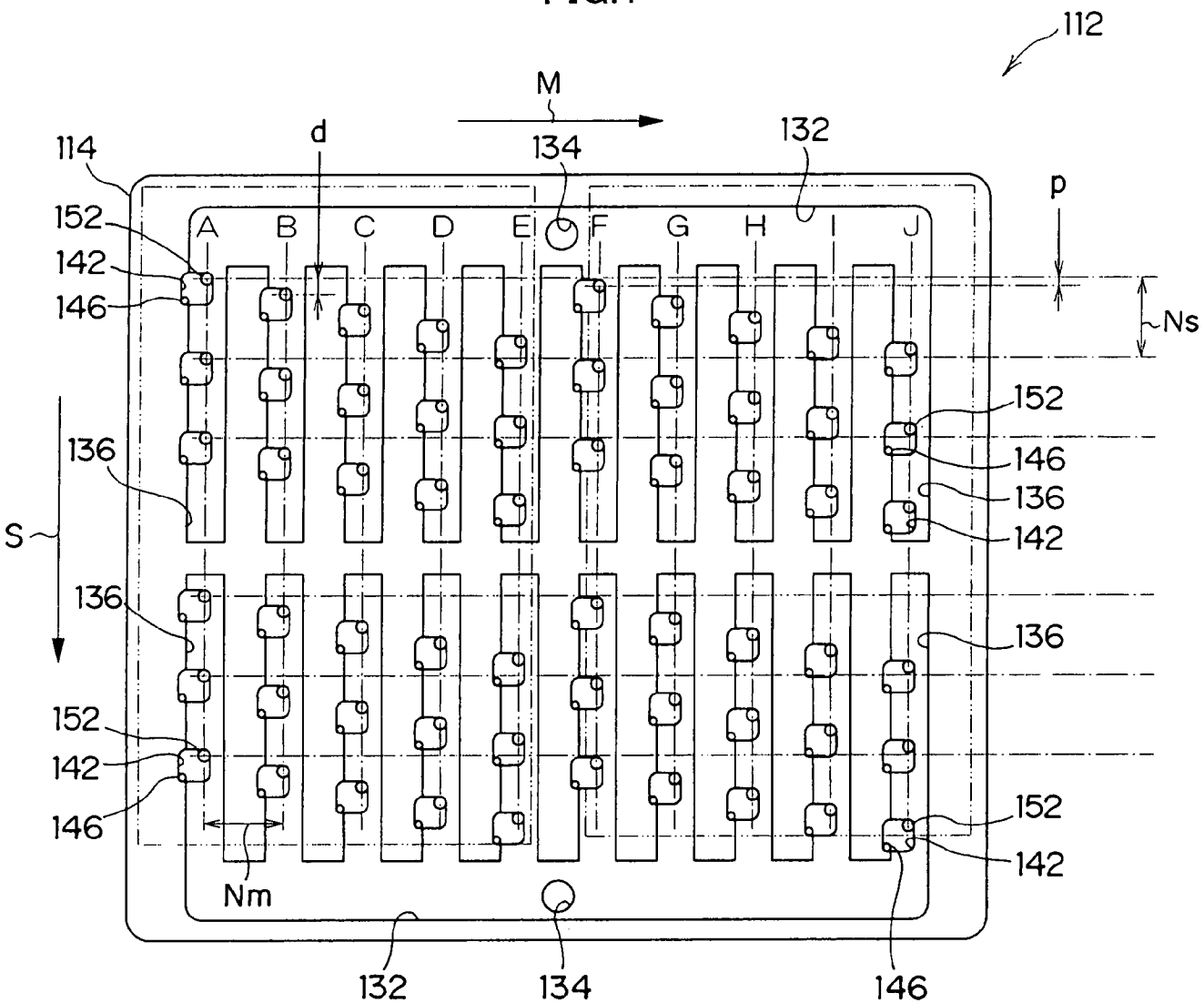
FIG. 1 is a plan view schematically showing an arrangement of an ejector, a common channel, and a second common channel of a droplet ejecting head according to a first embodiment of the present invention.
Figure 2:
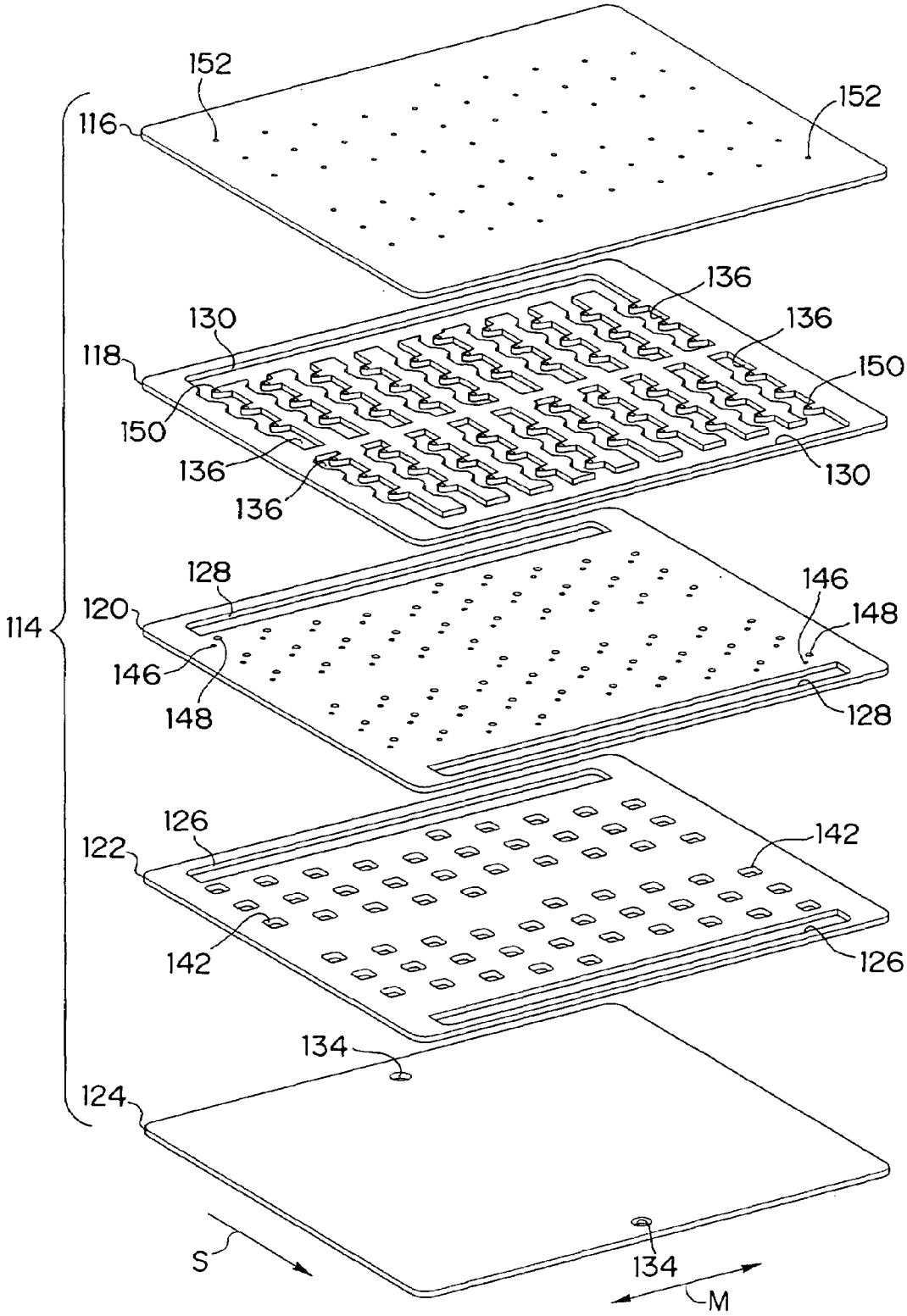
FIG. 2 is an exploded perspective view showing a configuration of a plate of the droplet ejecting head according to the first embodiment of the invention.
Figure 3:
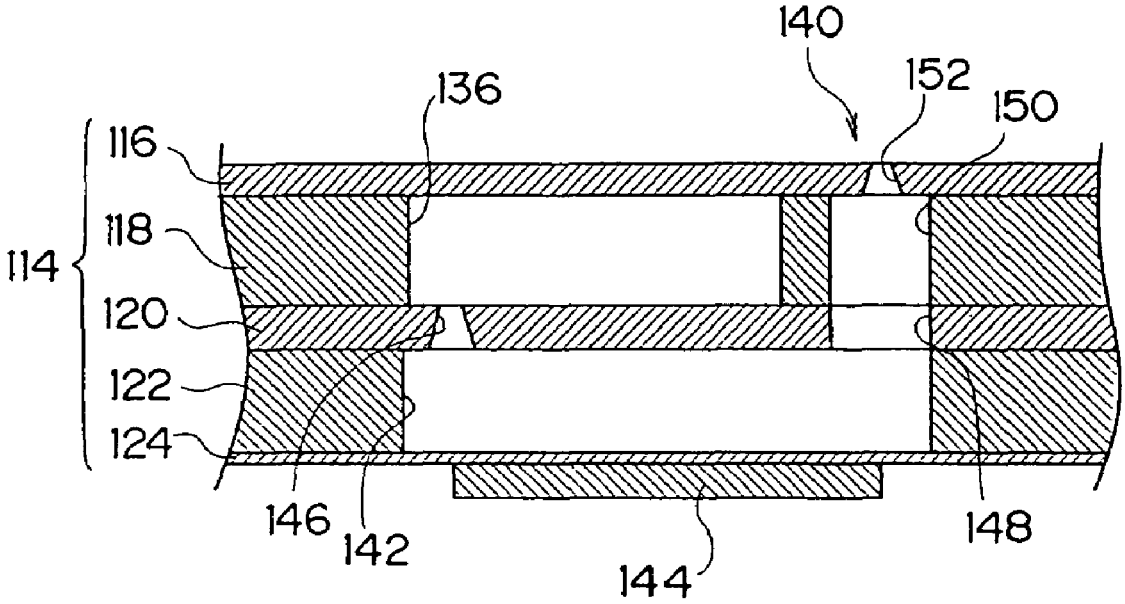
FIG. 3 is a sectional view showing the ejector of the droplet ejecting head according to the first embodiment of the invention.
Figure 4:
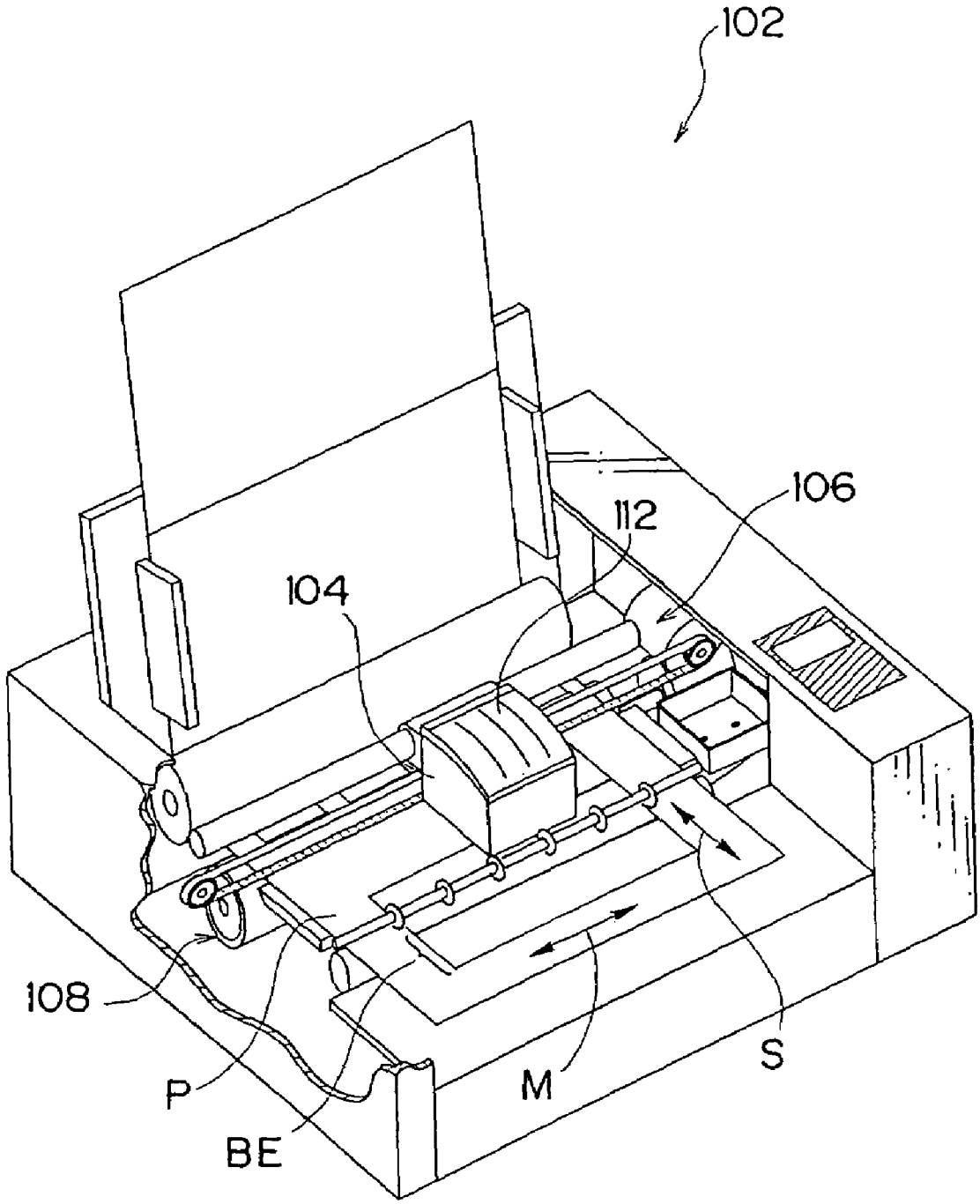
FIG. 4 is a perspective view showing a droplet ejecting apparatus according to the first embodiment of the invention.

FIGS. 1 to 3 partly show a droplet ejecting head 112 of a first embodiment of the invention. FIG. 4 shows a droplet ejecting apparatus 102 including the droplet ejecting head 112. The droplet ejecting head 112 of the embodiment is the so-called inkjet recording head, and the droplet ejecting apparatus 102 including the droplet ejecting head 112 is an inkjet recording apparatus. The droplet ejecting apparatus 102 is used in order to eject a droplet of colored ink (ink droplet) on a sheet of recording paper P which is a recording medium and record images by dots 158 (see FIG. 8B) generated by the droplets.

As shown in FIG. 4, the droplet ejecting apparatus 102 is configured to include a carriage 104 on which the droplet ejecting head 112 is mounted, a main scanning mechanism 106 which moves the carriage 104 in a predetermined main scanning direction along a recording surface of the recording paper P (main scan), and a sub-scanning mechanism 108 for feeding the recording paper P in a predetermined sub-scanning direction intersecting (preferably orthogonal to) the main scanning direction (sub-scan). In the drawings, the main scanning direction is indicated by an arrow M and the sub-scanning direction is indicated by an arrow S, respectively.

The droplet ejecting head 112 is mounted on the carriage 104 such that a nozzle surface in which nozzles 140 described below are formed faces the recording paper P. The droplet ejecting head 112 effects image recording in a predetermined band area BE of the recording paper P by ejecting the droplets onto the recording paper P in the band area, while the droplet ejecting head 112 is moved in the main scanning direction by the main scanning mechanism 106. When one movement in the main scanning direction is completed, the recording paper P is fed in the sub-scanning direction by the sub-scanning mechanism 108, and then the recording in the next band area is performed while the carriage 104 is moved again in the main scanning direction. By performing multiple repetitions of the above-mentioned operation, the image recording can be performed over the surface of the recording paper P.

As shown in FIG. 2, the droplet ejecting head 112 has a laminated channel plate 114. In the laminated channel plate 114, five plates, i.e., a nozzle plate 116, a common channel plate 118, a feed channel plate 120, a pressure generating chamber plate 122, and vibrator plate 124 are aligned with one another and laminated with bonding the five plates by using bonding means such as a bonding agent. In the pressure generating chamber plate 122, the feed channel plate 120, and the common channel plate 118, two long apertures 126, 128, and 130 are formed in parallel along the main scanning direction. Second common channels 132 (see FIG. 1) are configured by the long apertures 126, 128, and 130 in a state in which the pressure generating chamber plate 122, the feed channel plate 120, and the common channel plate 118 are laminated.

In the vibrator plate 124, ink feed apertures 134 are formed at a position corresponding to each of the centers of the second common channels 132. An ink feed device (not shown) is connected to the ink feed aperture 134.

In the common channel plate 118, a plurality of common channels 136 (ten common channels per one long aperture 130 of second common channel 132 in the embodiment) are continuously formed, along the sub-scanning direction, from the long aperture 130. Liquid flows through the common channels 136 in a state in which the feed channel plate 120, the common channel plate 118, and the nozzle plate 116 have been laminated.

In the pressure generating chamber plate 122, a plurality of pressure generating chambers 142 (in the embodiment, three pressure generating chambers per one common channel 136, and 60 pressure generating chambers in the droplet ejecting head 112 as a whole) are formed along the common channel 136. An single plate type piezoelectric actuator 144 as means for generating pressure is mounted on the vibrator plate 124 corresponding to each pressure generating chamber 142 (see FIG. 3). In the feed channel plate 120, as can be seen from FIG. 1, one ink feed channel 146 and one ink exhaust channel 148 are formed in each pressure generating chamber 142 so as to be substantially located on a diagonal line when the pressure generating chamber 142 is viewed in a plane. In the common channel plate 118 and the nozzle plate 116, a communicating channel 150 and an ink ejecting opening 152 are formed at the position corresponding to the ink exhaust channel 148, respectively. A nozzle 140 is configured by the ink exhaust channel 148, the communicating channel 150, and the ink ejecting opening 152. An ejector 138 (nozzle 140) is configured by the pressure generating chamber 142, the nozzle 140, and the piezoelectric actuator 144.

Accordingly, as can be seen from the sectional view shown in FIG. 3, an ink passage communicating from the common channel 136 to the ink ejecting opening 152 through the pressure generating chamber 142, the ink exhaust channel 148, and the communicating channel 150 is configured. The ink fed from the ink feed device (not shown) is supplied to the droplet ejecting head 112 through the ink feed aperture 134, and the pressure generating chamber 142 is filled with the ink supplied from the second common channel 132 through each common channel 136. When a driving voltage waveform according to image information is applied to the piezoelectric actuator 144, the piezoelectric actuator 144 is deformed to expand or compress the pressure generating chamber 142. This causes a change in a volume to the pressure generating chamber 142, whereby a pressure wave is generated within the pressure generating chamber 142. The ink in the nozzle 140 (the ink exhaust channel 148, the communicating channel 150, and the ink ejecting opening 152) is moved by the action of the pressure wave and the ink is exhausted from the ink ejecting opening 152 to the outside, whereby a droplet is formed.

Figure 5A:
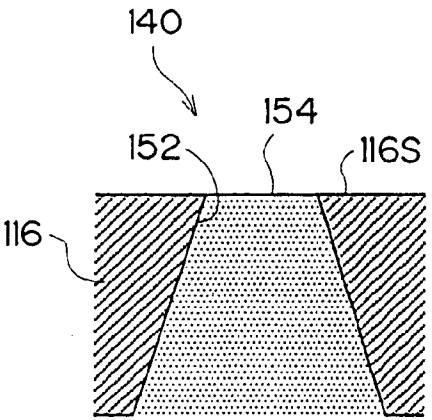
FIGS. 5A to 5F are explanatory views showing, in the order of FIG. 5A to FIG. 5F, changes in a meniscus observed when a droplet is ejected from a nozzle in the droplet ejecting head.
Figure 5B:
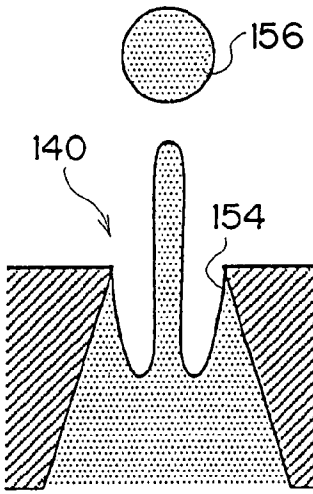
Figure 5C:
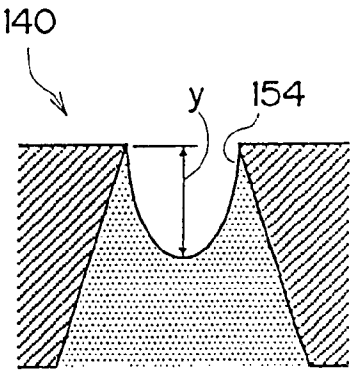
Figure 5D:
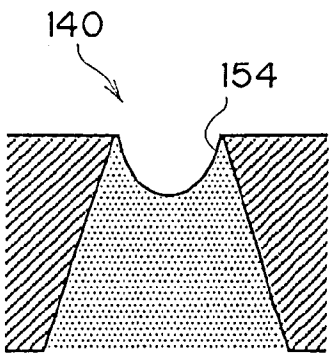
Figure 5E:
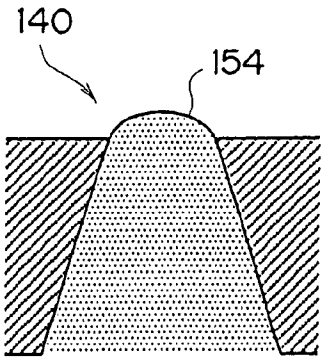
Figure 5F:
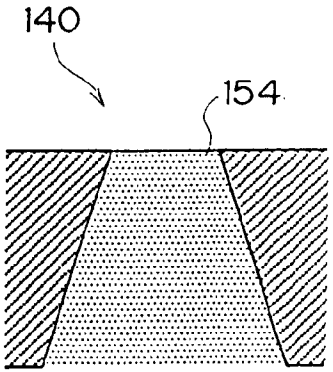

FIGS. 5A to 5F schematically show a series of action of a meniscus 154 at the ink ejecting opening 152 before and after the ejection of a droplet, in the order from FIG. 5A to FIG. 5F. At first, the meniscus 154 is substantially flat (FIG. 5A). When the pressure generating chamber 142 is compressed, the meniscus 154 is moved toward the outside of the ink ejecting opening 152 to eject a droplet 156 (FIG. 5B). Since an ink quantity within the ink ejecting opening 152 is decreased when the droplet 156 is ejected, the concave meniscus 154 is formed (FIG. 5C). The concave meniscus 154 gradually returns to an aperture portion of the ink ejecting opening 152 by the action of surface tension of the ink (FIGS. 5D and 5E) and restores the state before ejecting (FIG. 5F). Hereinafter the action of the meniscus which restores the original state thereof before ejection, after ejecting a droplet, will be referred to as "refill" and a time required for the meniscus 154 to return to an aperture surface 116S of the ink ejecting opening 152 for the first time after the ejection of a droplet will be referred to as "refill time (tr)" hereinafter.

Figure 6:
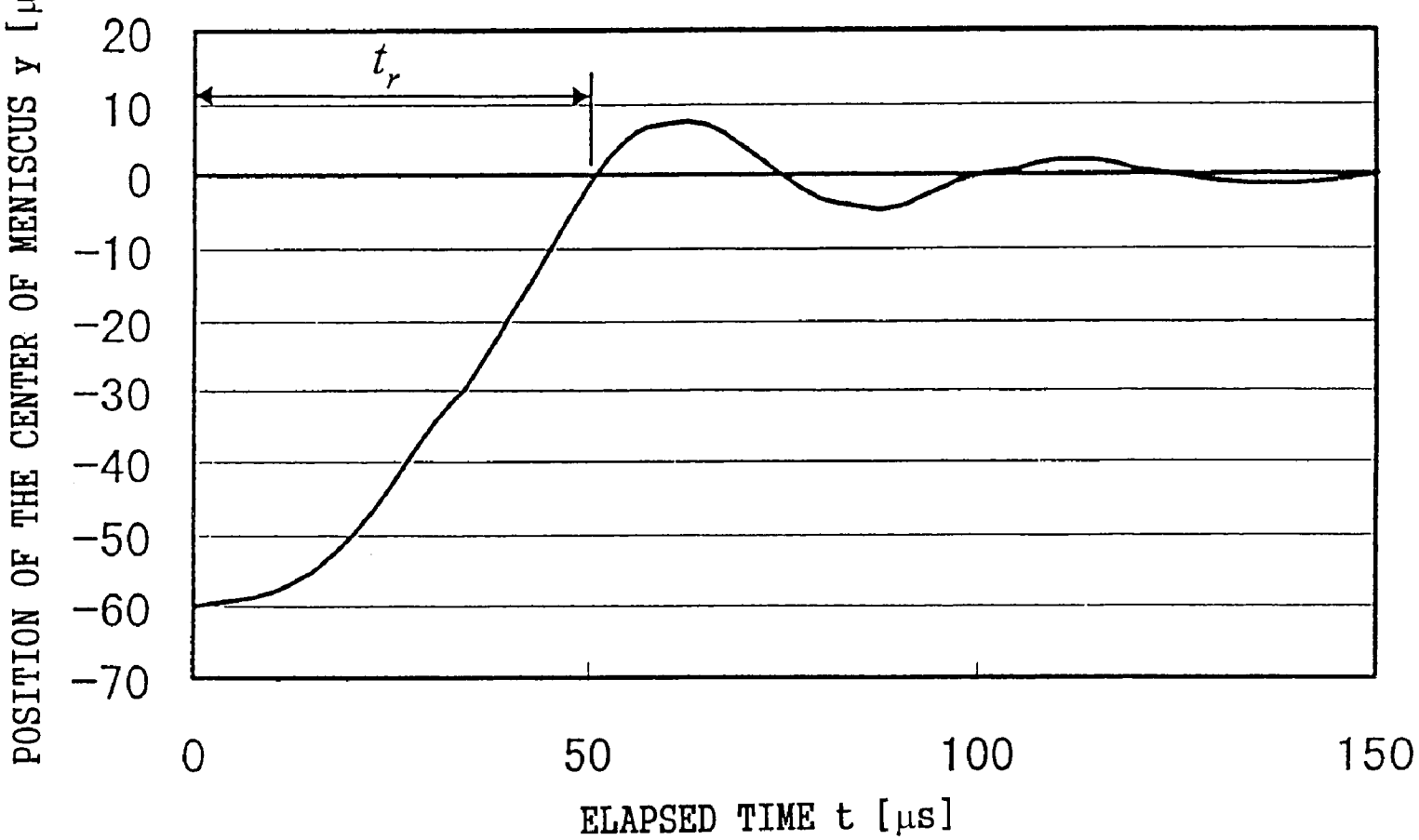
FIG. 6 is a graph showing an example of a relationship between an elapsed time and a position of the center of the meniscus during refilling the droplet ejecting head.

FIG. 6 is a graph showing the relationship between an elapsed time counted from immediately after ejecting the droplet 156 and a change of a position of the meniscus (a position y at the center of the meniscus, see FIG. 5C). As shown in the graph, the meniscus which has significantly receded immediately after ejecting the droplet (y=−60 μm at t=0) returns to the initial position (y=0) with oscillation.

Figure 7:
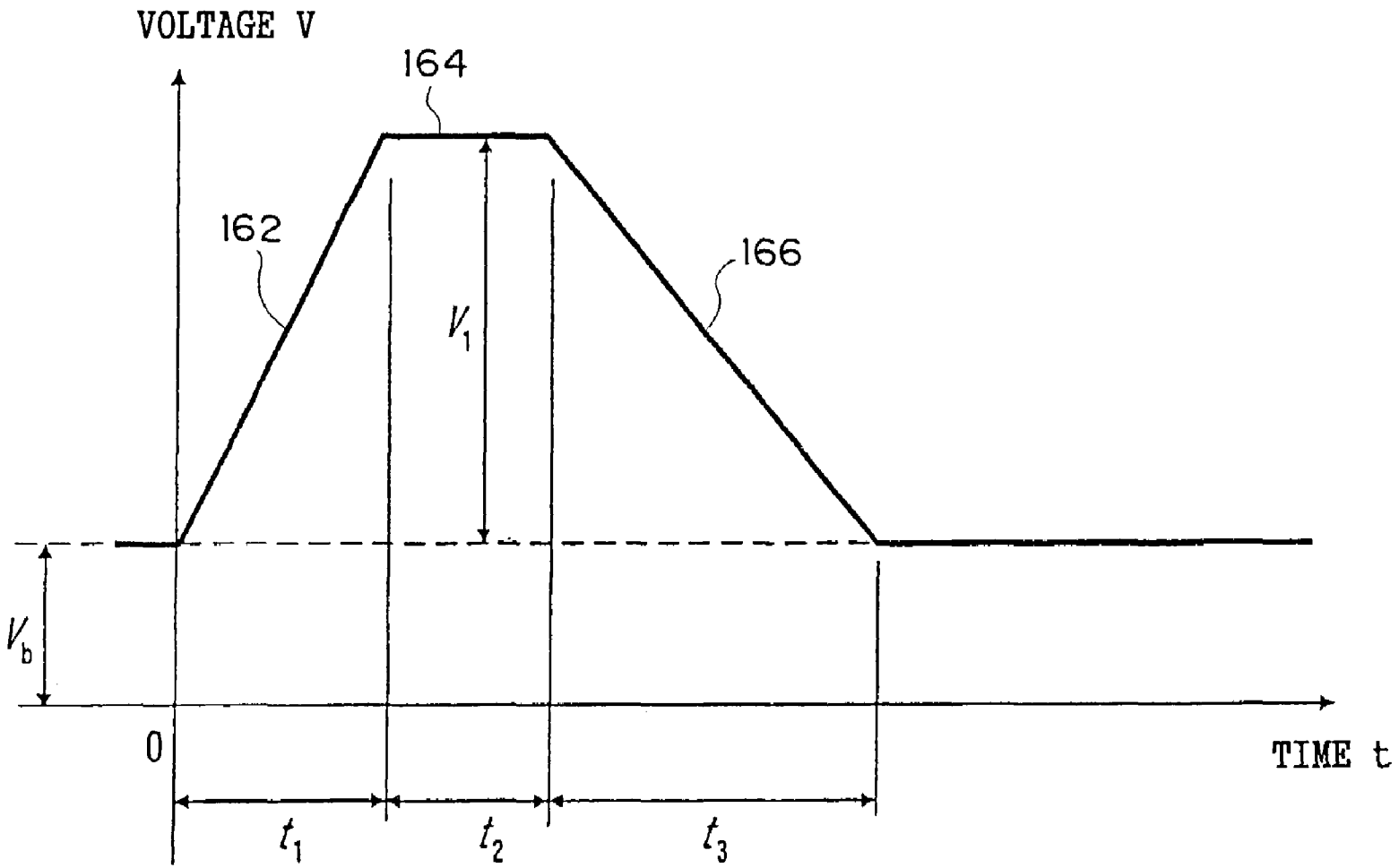
FIG. 7 is a graph showing an example of driving voltage applied to a piezoelectric actuator of the droplet ejecting head according to the first embodiment of the invention.

FIG. 7 shows an example of a waveform of the driving voltage applied to the piezoelectric actuator 144. The waveform of the driving voltage includes a first voltage change process 162 (required time t1) for changing the voltage in a direction which compresses the pressure generating chamber 142, a voltage maintaining process 164 (required time t2) for maintaining the changed voltage (high voltage) for a predetermined period, and a second voltage change process 166 (required time t3) for returning the applied voltage to bias voltage (Vb).

In the case where a flexure-deformation type piezoelectric actuator is used as the pressure generating means, by setting an aspect ratio (ratio of longitudinal dimension to horizontal dimension viewed in plane) of the pressure generating chamber 142 at approximately 1, ejection efficiency per unit area can be maximized and a large droplet can be ejected by using a small pressure generating chamber 142. In other words, a matrix-like nozzle arrangement head having high-arrangement density, in which an ink-occupied area of the pressure generating chamber 142 is minimized, can be realized. From such a viewpoint, the aspect ratio preferably is in a range from not lower than 0.50 to not more than 2.00, and more preferably in a range from not lower than 0.80 to not more than 1.25. However, needless to say, the aspect ratio is not limited to the above-mentioned range.

Figures 8A, 8B:
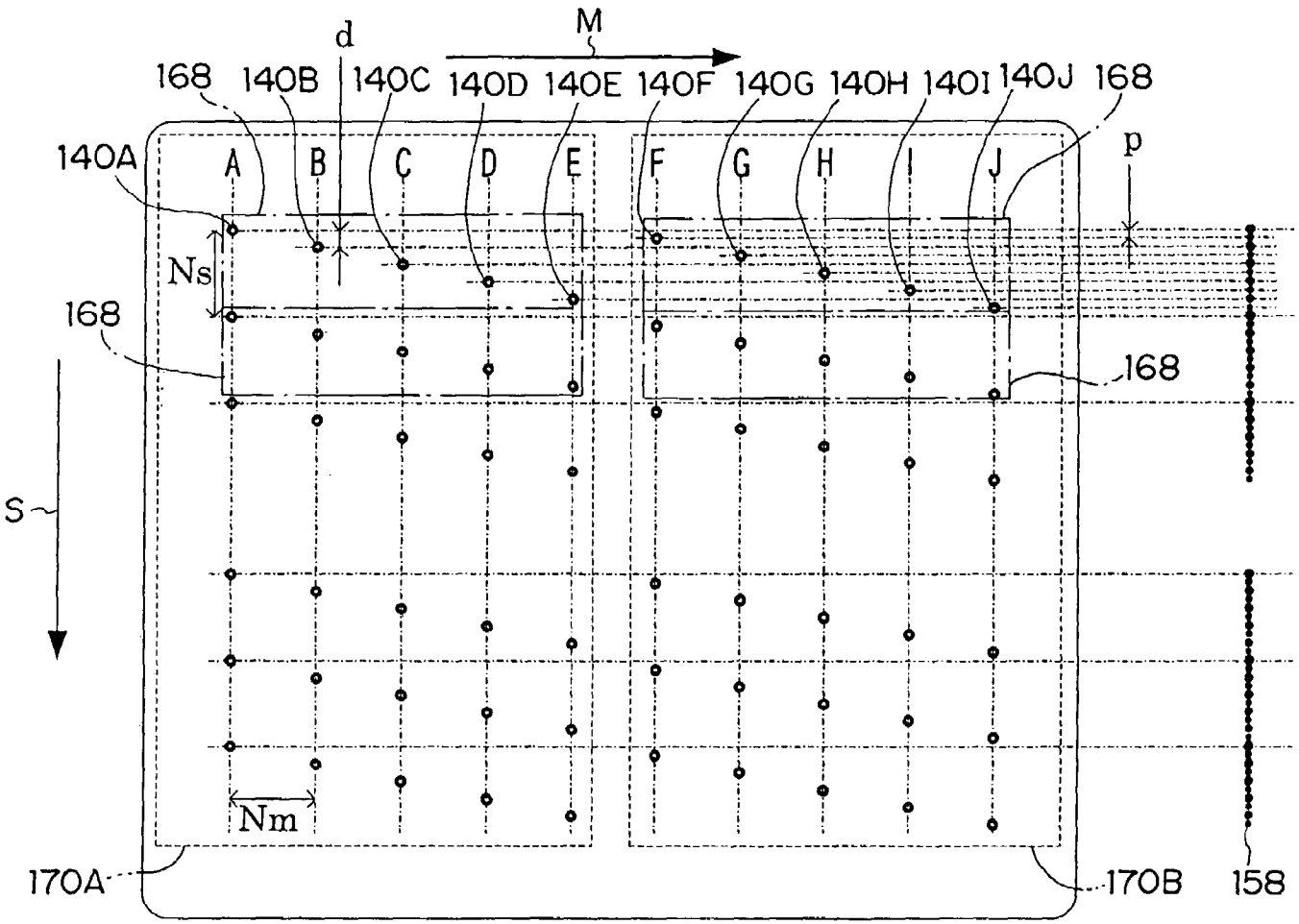
FIG. 8A is a plan view schematically showing the arrangement of the ejectors of the droplet ejecting head according to the first embodiment of the invention.
FIG. 8B is an explanatory view showing dots formed by the droplets ejected from the droplet ejecting head of FIG. 8A in a manner that the dots are arranged in line in a direction orthogonal to a main scanning direction.

FIG. 8A schematically shows an arrangement of the nozzle 140 (ejector 138) in the embodiment. The plurality of nozzles 140 are arranged in the form of the matrix with a matrix pitch Nm in the main scanning direction and a matrix pitch Ns in the sub-scanning direction. As can be seen from the aforementioned description, in the invention, the nozzle 140 is provided at the same position for the corresponding ejector 138. Therefore, the relative positional relationship between the nozzles 140 directly corresponds to the relatively positional relationship between the ejectors 138.

In the droplet ejecting head 112 of the embodiment, it is assumed that the droplet ejecting head 112 is divided in the main scanning direction into two ejector blocks 170A and 170B in a state in which the droplet ejecting head 112 faces the recording paper P. In each of the ejector blocks 170A and 170B, an ejector unit 168 is constituted of a row of nozzles 140 (each row of each ejector block includes five nozzles 140). In each of the ejector blocks 170A and 170B, a plurality of rows are disposed from the upstream side (upper side in FIG. 8A) in the sub-scanning direction. The five ejectors 140A to 140E are disposed such that the ejectors are offset from each other, by two times (indicated by d) as much as the desired nozzle pitch p, in the main scanning direction. The five ejectors 140F to 140J are disposed such that the ejectors are offset from each other, by two times (indicated by d) as much as the desired nozzle pitch p, in the main scanning direction. Further, the ejector block 170B is offset relative to the ejector block 170A toward the downstream side of the sub-scanning direction, by the nozzle pitch p. As a result, the desired nozzle pitch p is obtained as a whole of the droplet ejecting head 112.

As the above-described arrangement of the nozzles 140 is employed, the positions of the nozzles 140 (ejectors 138) in the main scanning direction alternate in an offsetting manner, when the nozzles 140 are viewed in order in the sub-scanning direction. As a result, a cyclic change in a dot diameter in the sub-scanning direction is suppressed or made less conspicuous, whereby recorded image becomes highly uniform. This effect will be described in detail below. In the following description, when the nozzles 140 (ejectors 138) are viewed in order in the sub-scanning direction, the positional change in the main scanning direction, of the nozzles 140 (ejectors 138), will be referred to as "a change in the matrix-like nozzle arrangement". Further, a line of the nozzles of the matrix-like nozzle arrangement in the main scanning direction will be referred to as "row", the line of the nozzles of the matrix-like nozzle arrangement in the sub-scanning direction will be referred to as "column", and the line of the dots in the main scanning direction on the recording medium will be referred to as "raster."

Figure 9:
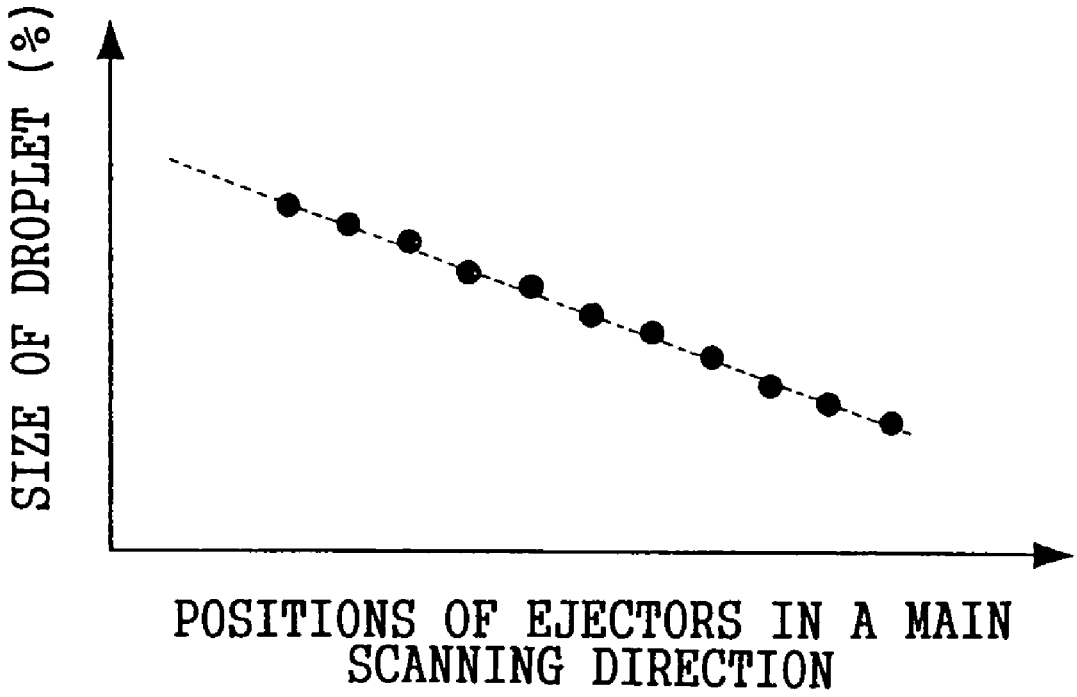
FIG. 9 is a graph showing qualitatively a general relationship between the position of the ejector in the main scanning direction and a size of the droplet.

In general, in a droplet ejecting head including matrix-like arranged nozzles, the volume of a droplet ejected from each nozzle is changed depending on the position where the ejector is arranged in the laminated channel plate 114 (see FIGS. 2 and 3), and the volume changes according to a linear distribution of ejection characteristics. For example, in a case of a droplet ejecting head having the same configuration as that of the present embodiment, the size of a droplet (or the droplet volume) tends to vary depending on the position of the ejector, as shown in FIG. 9, which position of the ejector is often offset due to the positional deviation of the plates generated in a laminating process at the time of producing the laminated channel plate 114. There is also a tendency that the droplet volume somewhat varies in the sub-scanning direction. However, in the embodiment, the change in the droplet volume in the main scanning direction is mainly considered.

Figures 26A, 26B:
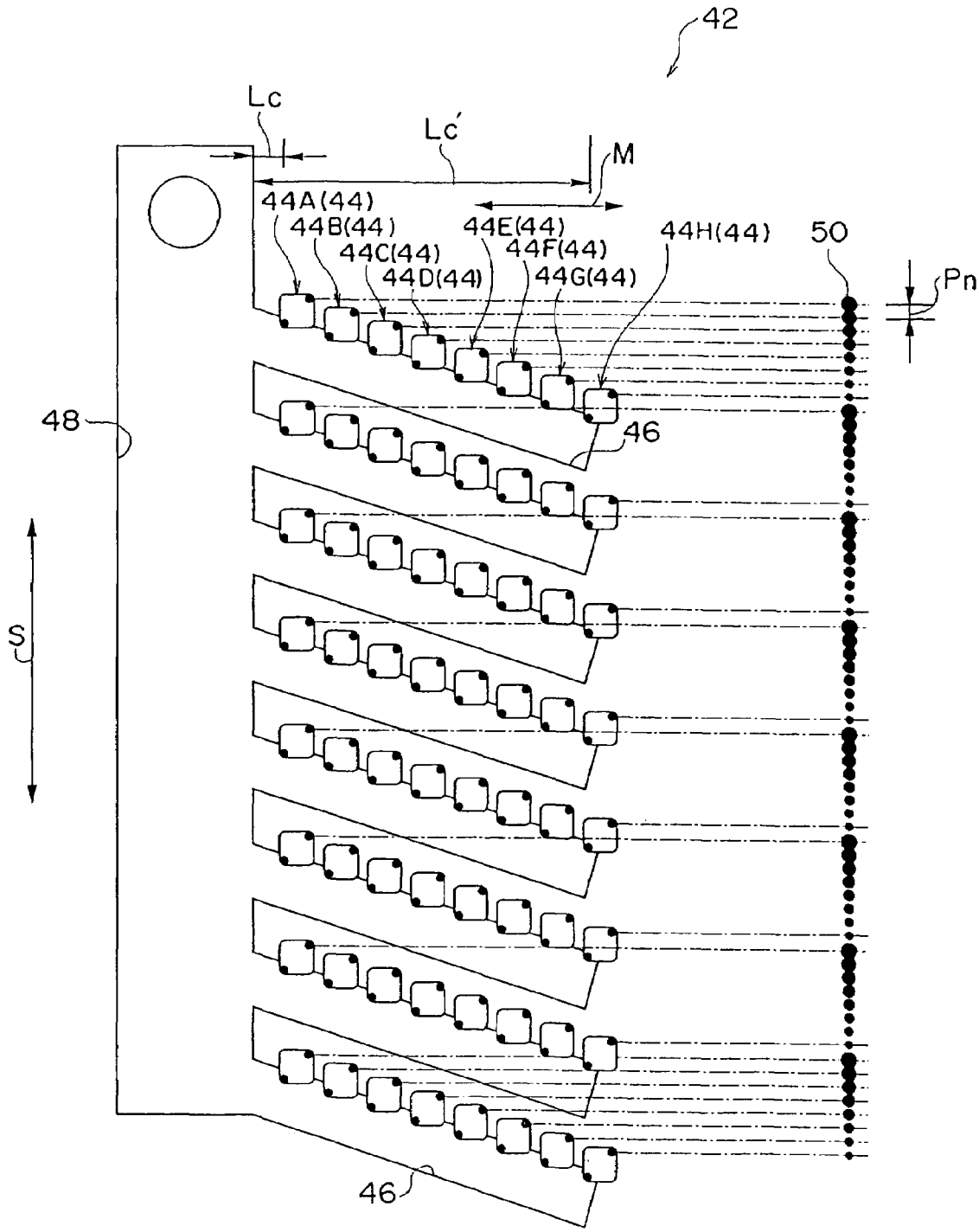
FIG. 26A is a plan view schematically showing the arrangement of the ejector of the conventional droplet ejecting head having a matrix-like nozzle arrangement.
FIG. 26B is an explanatory view showing the dots formed by the droplets ejected from the droplet ejecting head of FIG. 26A in a manner that the dots are arranged in line in the direction orthogonal to the main scanning direction.
Figures 27A, 27B:
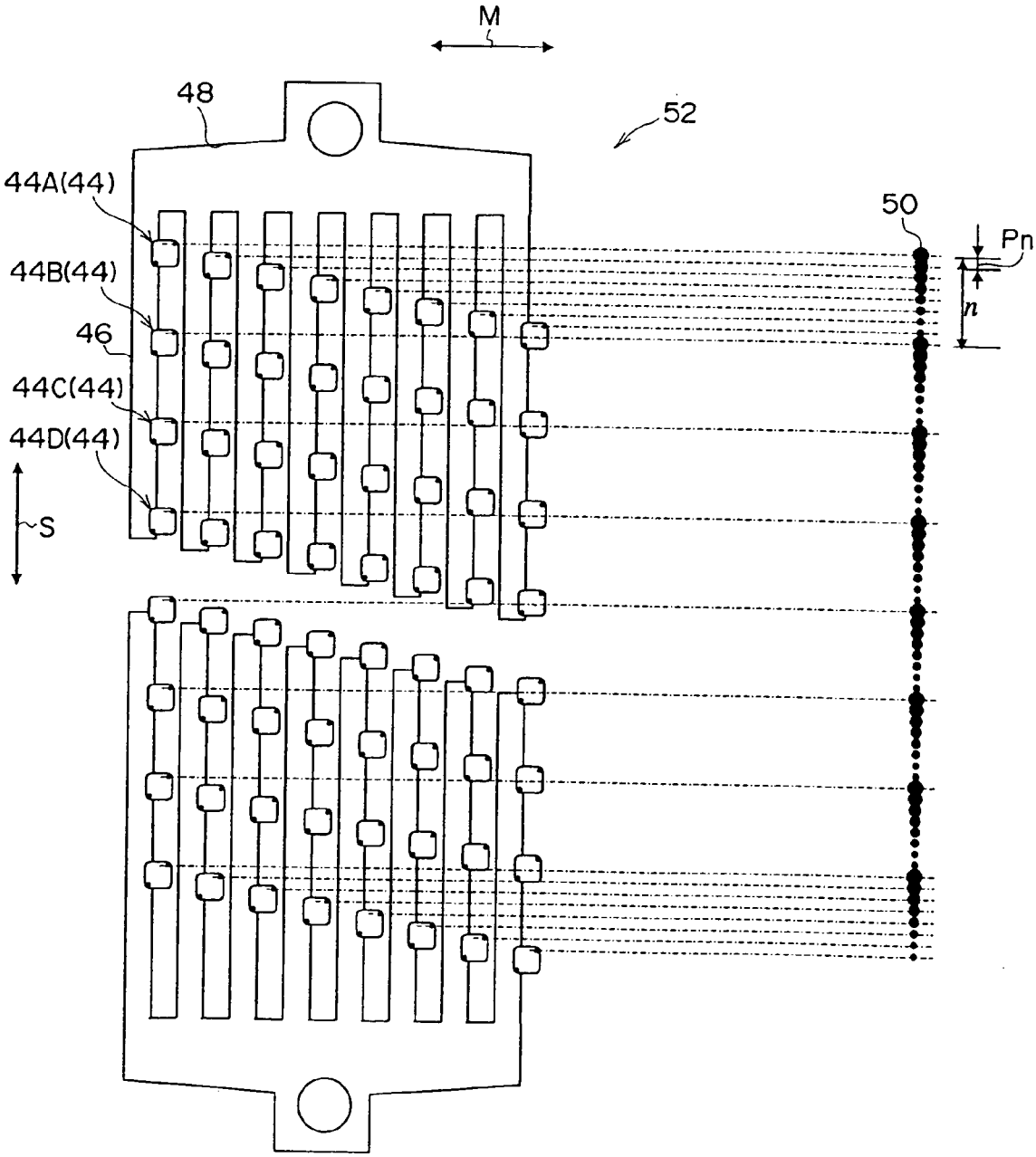
FIG. 27A is a plan view schematically showing another arrangement of the ejector of the conventional droplet ejecting head having the matrix-like nozzle arrangement.
FIG. 27B is an explanatory view showing the dots formed by the droplets ejected from the droplet ejecting head of FIG. 27A in a manner that the dots are arranged in line in the direction orthogonal to the main scanning direction.
Figure 28A:
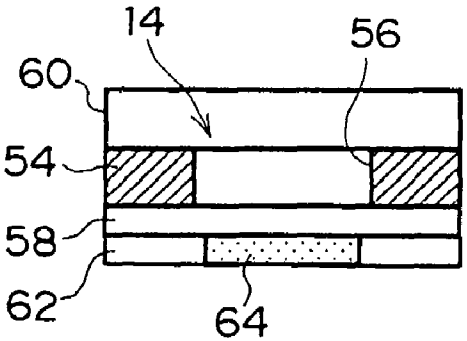
FIGS. 28A to 28D are explanatory views each showing deviation caused by rotation of a plate constituting the droplet ejecting head.
Figure 28B:
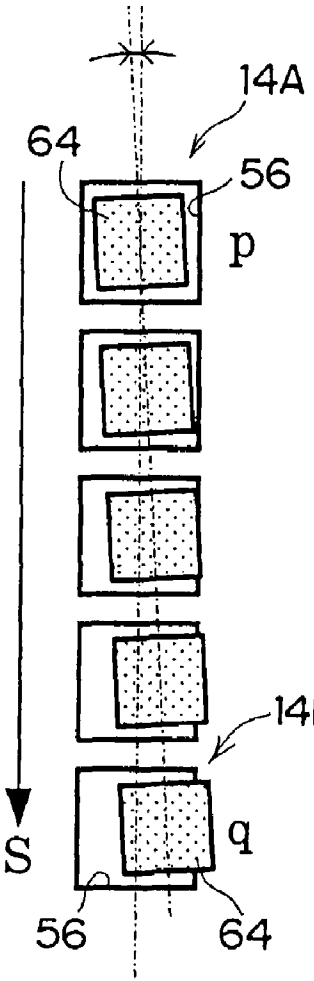
Figure 28C:
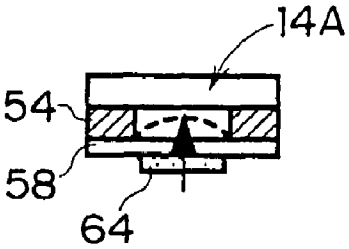
Figure 28D:
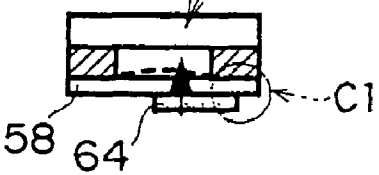

When the droplet volume changes, similarly to the conventional case shown in FIGS. 26A and 26B, there arises a patterned change in the dot diameter on the recording medium. That is, when the dots of the droplets ejected by a series of the ejectors 44A, 44B, 44C, 44D, 44E, 44F, 44G and 44H which are continuous in the main scanning direction are arranged in the sub-scanning direction with the constant pitch p, a patterned or cyclic change in the dot diameters, having a cycle of the matrix pitch Ns, appears in the sub-scanning direction.

Figure 10:
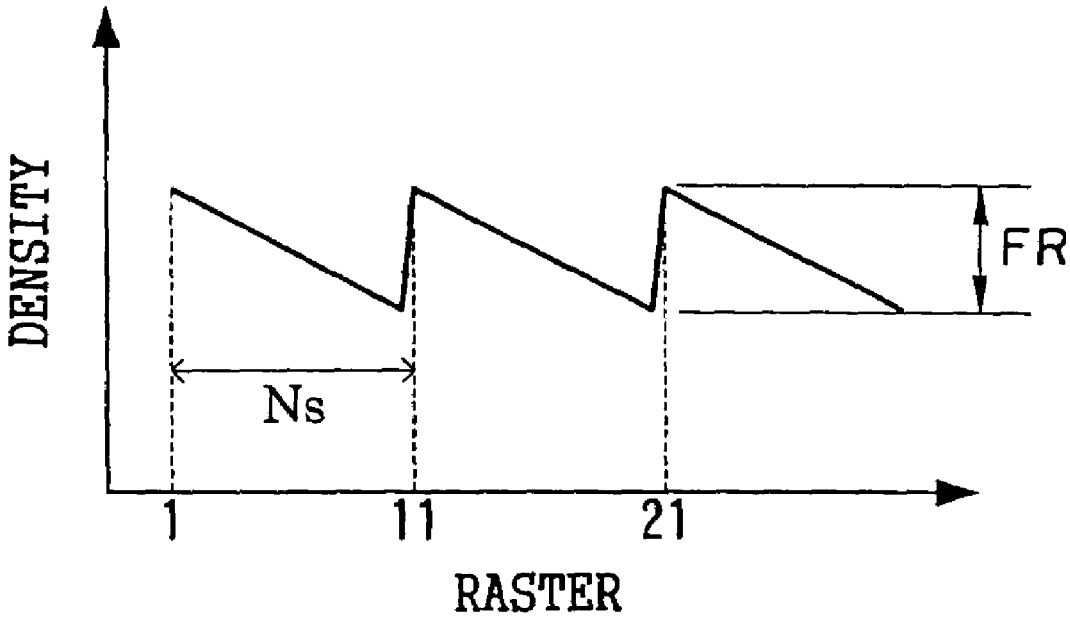
FIG. 10 is a graph showing the relationship between a raster and a density in the conventional droplet ejecting head.

FIG. 10 shows the relationship between the raster (line of dots 158) and the density, in the sub-scanning direction, in the conventional droplet ejecting head. It is understood from the graph of FIG. 10 that the density is cyclically changed with the cycle of the matrix pitch Ns in the sub-scanning direction and a pattern in the cyclic change in the dot diameters is obvious.

Figure 11:
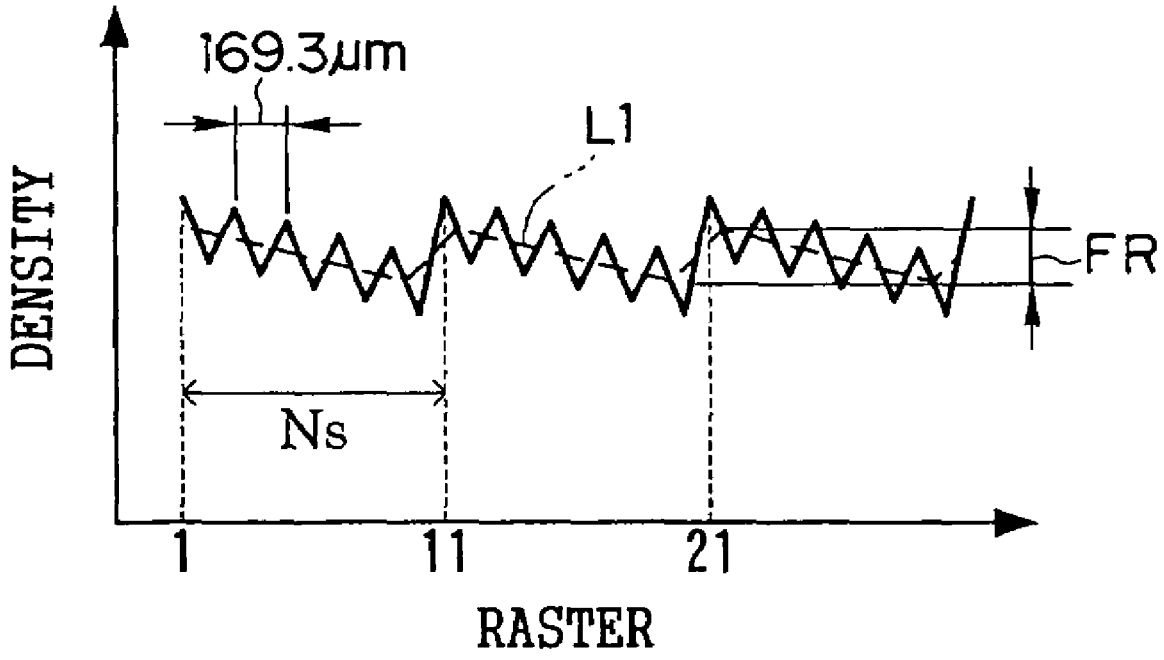
FIG. 11 is a graph showing the relationship between the raster and the density in the droplet ejecting head according to the first embodiment of the invention.

On the other hand, in the droplet ejecting head 112 of the embodiment, as described above, since the raster is alternately recorded by the nozzles 140 of the two ejector blocks 170A and 170B, the positions in the main scanning direction of the nozzles 140 (ejectors 138) are changed in an alternately offsetting manner when the nozzles 140 (ejectors 138) are viewed in order in the sub-scanning direction. As a result, the sizes of the dots are changed at random when the actual dots 158 are viewed along the sub-scanning direction (see FIG. 8B). As shown in FIG. 11, the density is changed with the fluctuation cycle of two rasters in the relationship between the raster and the density in the sub-scanning direction. As the sizes of the dots 158 on the recording paper P are changed at random in the sub-scanning direction, a cyclic change in the dot diameter in the sub-scanning direction is suppressed and the recording image has the high uniformity.

In the droplet ejecting head including the matrix-like nozzle arrangement, the density of the recording image could become uneven by the rotational deviation (so-called θ deviation) within a plane of the nozzle plate, which deviation is generated in mounting the head having the matrix-shaped nozzle arrangement on the carriage 104 (see FIG. 4).

Figure 12A:
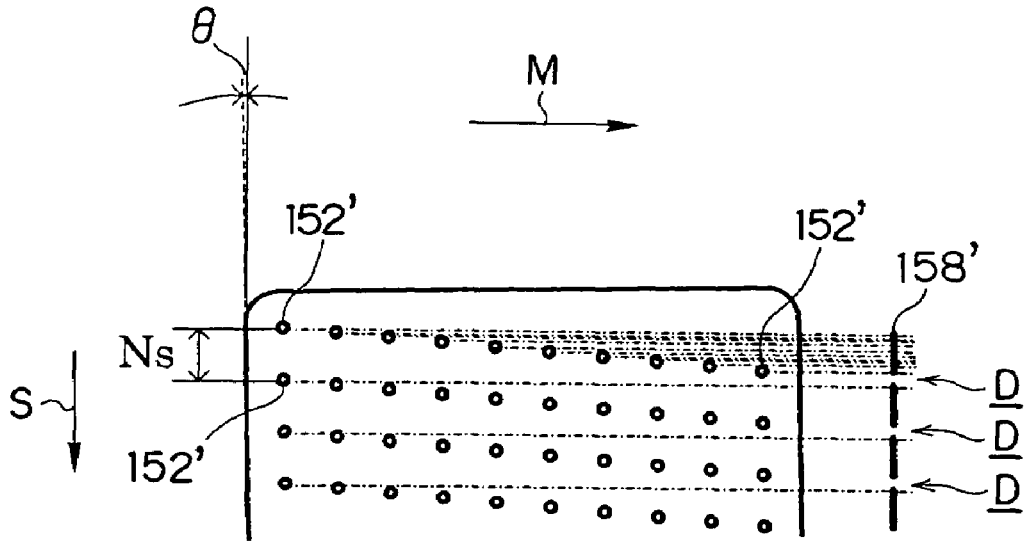
FIG. 12A is an explanatory view showing a case in which rotational deviation has been generated in mounting the conventional droplet ejecting head onto a carriage.

FIG. 12A shows that changes in density occur when the θ deviation is generated in the conventional head having a matrix-like nozzle arrangement. The head having the matrix-like nozzle arrangement shown in FIG. 12A is rotationally (counterclockwise in the drawing) deviated, although the deviation is small. This results in a gap D in the column of the dots 158' recorded. The gap D is generated at a point where the nozzles 152' recording the image is changed from one row to another row, and the cycle of the gap D generation is equal to the matrix pitch Ns. It can be concluded that the gap D is the sufficiently visible fluctuation in the density.

Figure 12B:
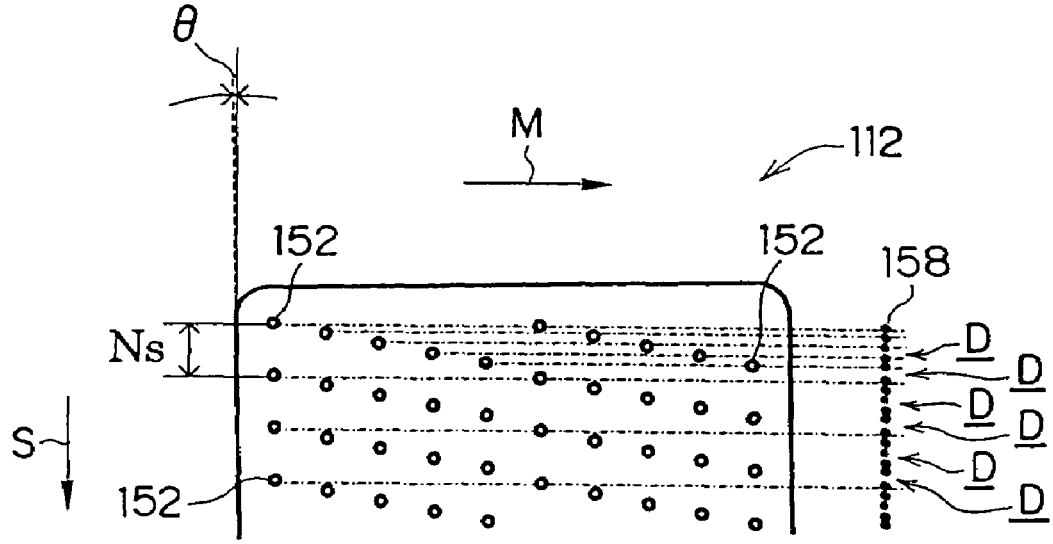
FIG. 12B is an explanatory view showing a case in which rotational deviation has been generated in mounting the droplet ejecting head according to the first embodiment of the invention onto the carriage.

FIG. 12B shows a case in which fluctuation in the density occurs due to a θ deviation in the droplet ejecting head 112 of the embodiment. Comparing the dots 158 recorded by using the droplet ejecting head 112 with the dots 158' of FIG. 12A, it is observed that frequency of the gap is increased. That is, the cycle of the fluctuation in the density is shortened. The gap becomes less visible as a result of this shortened cycle, and the uniformity of the density can be achieved.

Figure 13:
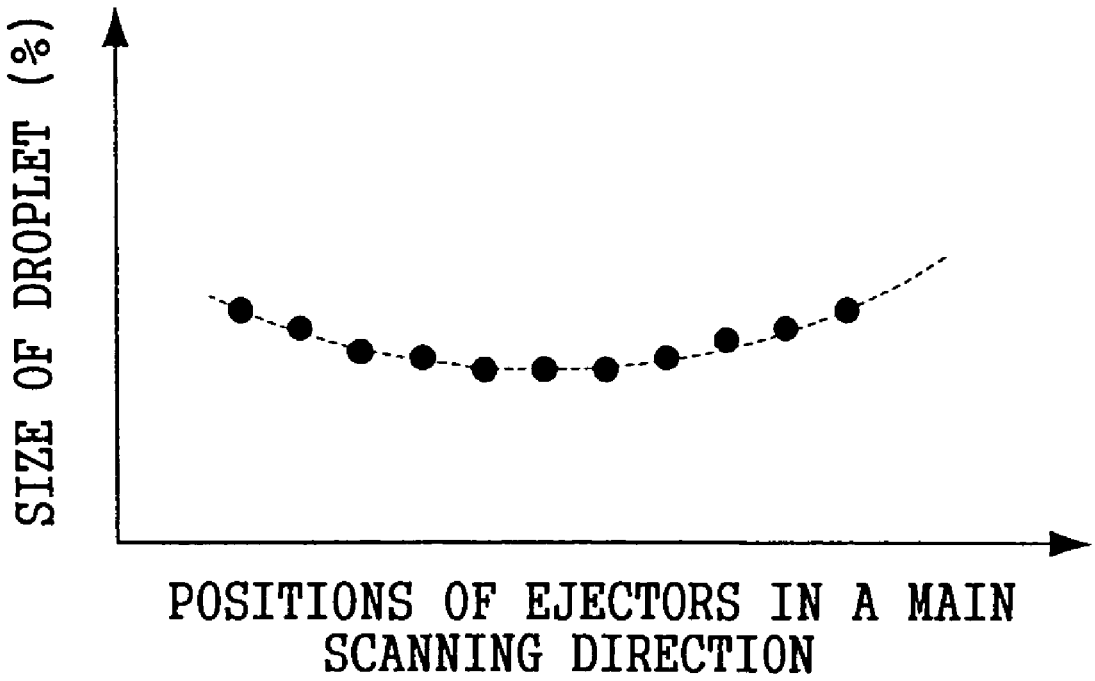
FIG. 13 is a graph showing qualitatively the relationship between the position of the ejector in the main scanning direction and the size of the droplet, which is different from the relationship shown in FIG. 9.

In the ejector 138, the ejecting characteristics thereof at the center of the aperture surface 116S may be different from those at the peripheral portion of the aperture surface 116S. For example, as shown in FIG. 13, there is a case in which the size of a droplet is gradually increased, as the position of the nozzle 140 shifts from the center toward the peripheral portion (edge portion) of the aperture surface 116S. Such an ejection characteristics distribution of the ejector 138 may be observed in a case where the pressure generating chamber plate 122 is manufactured by etching, for example. In general, etching proceeds fastest in the peripheral portion of a matrix. Or, etching might proceed slowest in the peripheral portion of a matrix, depending on the conditions. In either of the cases, the dimension of the pressure generating chamber varies between the peripheral portion of the matrix and the center portion thereof and, as a result, the ejection characteristics are changed. This change in the ejection characteristics (distribution) may result in fluctuation, with a cycle of the matrix pitch, of density. On the contrary, in the droplet ejecting head 112 of the first embodiment, variations in the density can be made much less conspicuous than the conventional droplet ejecting head, even if the droplet ejecting head 112 has the above-described ejecting characteristics distribution which would cause conspicuous variation in density in the conventional droplet ejecting head.

When the droplet ejecting head 112 of the embodiment has the above-mentioned configuration, the specific sizes such as the nozzle pitch p and the matrix pitches Nm and Ns are not particularly limited. When recording is performed with resolution of 300 dpi (dots per inch) and the nozzle pitch p of 84.67 μm, the total number of nozzles is 220, which nozzles can be arranged in a matrix having ten columns from column A to column J. In this arrangement, the nozzles 140 of the ten columns are divided into the ejector blocks 170A and 170B on the right and left sides, each of which has five columns, at the center in the main scanning direction. Though the arrangements of the nozzles 140 within the ejector blocks 170A and 170B are the same, the ejector block 170B is shifted toward the sub-scanning direction relative to the ejector block 170A, and the ejector block 170B is located at the lower position than the ejector block 170A by the nozzle pitch p in the figure.

In the above-described configuration, the matrix pitch is 846.7 μm (ten times as much as the nozzle pitch p) in both the matrix pitch Nm in the main scanning direction and the matrix pitch Ns in the sub-scanning direction. In the ejector blocks 170A and 170B, the nozzles adjacent in the main scanning direction are offset from each other, in the sub-scanning direction, by d=nozzle pitch p×2 (169.3 μm). Accordingly, the image recording with the nozzle pitch p can be realized such that the ejectors of the ejector blocks 170A and 170B work in a complementary manner, to form a raster.

In a case where the droplet ejecting head 112 of the first embodiment is structured in such a specific configuration as described above, the linear ejection characteristics distribution is generated, and the volume of the droplet ejected from the nozzle 140J of the column J is smaller by 10% than the volume of the droplet ejected from the nozzle 140A of the column A in FIG. 8B. However, in the droplet ejecting head 112, since the nozzles 140 of the ejector blocks 170A and 170B alternately record the raster, the dot characteristics are changed in each raster on the recording medium and the density fluctuates up and down for each dot. The cycle of the fluctuation of the dot is a width of two rasters, and it is equal to 169.3 μm in the aforementioned specific arrangement of the nozzles. The region for which the human visual sensitivity is poor in FIG. 29 corresponds to the spatial frequency of no less than about 4 lines/mm (no more than 250 μm as a cycle). Accordingly, it is difficult to perceive the fluctuation in density having a cycle of 169.3 μm.

The fluctuation in density with the cycle of the matrix pitch Ns, which is problematic in the conventional droplet injecting head, becomes inconspicuous. Specifically, in FIG. 11, since the density changes with small fluctuations, with the cycle of two rasters, the fluctuation of the cycle of the matrix pitch Ns is inconspicuous. In FIG. 11, an average of movements is calculated between two dots, so that the density in which the small fluctuations have been eliminated is indicated by a broken line L1. Comparing FIG. 11 with FIG. 10, it is confirmed that a fluctuation range FR shown in FIG. 11 is narrower than that of the conventional matrix-like nozzle arrangement shown in FIG. 10.

Further, in the embodiment, it is not necessary to change the ejection characteristics of the droplet 156 by changing, for example, the shapes of the ejector 138 and the common channel 136, in order to decrease the density unevenness. Therefore, the highly dense arrangement of the ejectors 138 (nozzles 140) can be made compatible with a decrease in the density unevenness described above. Accordingly, it is possible to arrange the ejectors 138 with high density and record the image at high speed.

In the invention, the specific configuration of the arrangement of the ejectors 138 is not limited to the arrangement shown in FIG. 8A. In short, it suffices as long as the ejectors (nozzles) are arranged such that the position thereof in the main scanning direction alternate in an offsetting manner when the nozzles 140 (ejectors 138) are viewed in order in the sub-scanning direction. When the ejectors (nozzles) are arranged in such a manner, the dot size of the droplet is changed at random, as seen in the sub-scanning direction, whereby the density unevenness can be decreased. In the following embodiments, droplet ejecting heads of other types satisfying the above-mentioned condition will be described. In each of the following embodiments, as the configuration of the five plates and the basic structure of each ejector 138 (nozzle 140) are the same as those of the first embodiment, the same parts and components in the following embodiments are designated by the same reference numerals and signs as the first embodiment and the detailed description thereof will be omitted. Further, as the droplet ejecting apparatus using the droplet ejecting head of each embodiment also has substantially the same configuration as the droplet ejecting apparatus 102 of the first embodiment, the description thereof will be omitted.

[Second Embodiment]

Figures 14A, 14B:
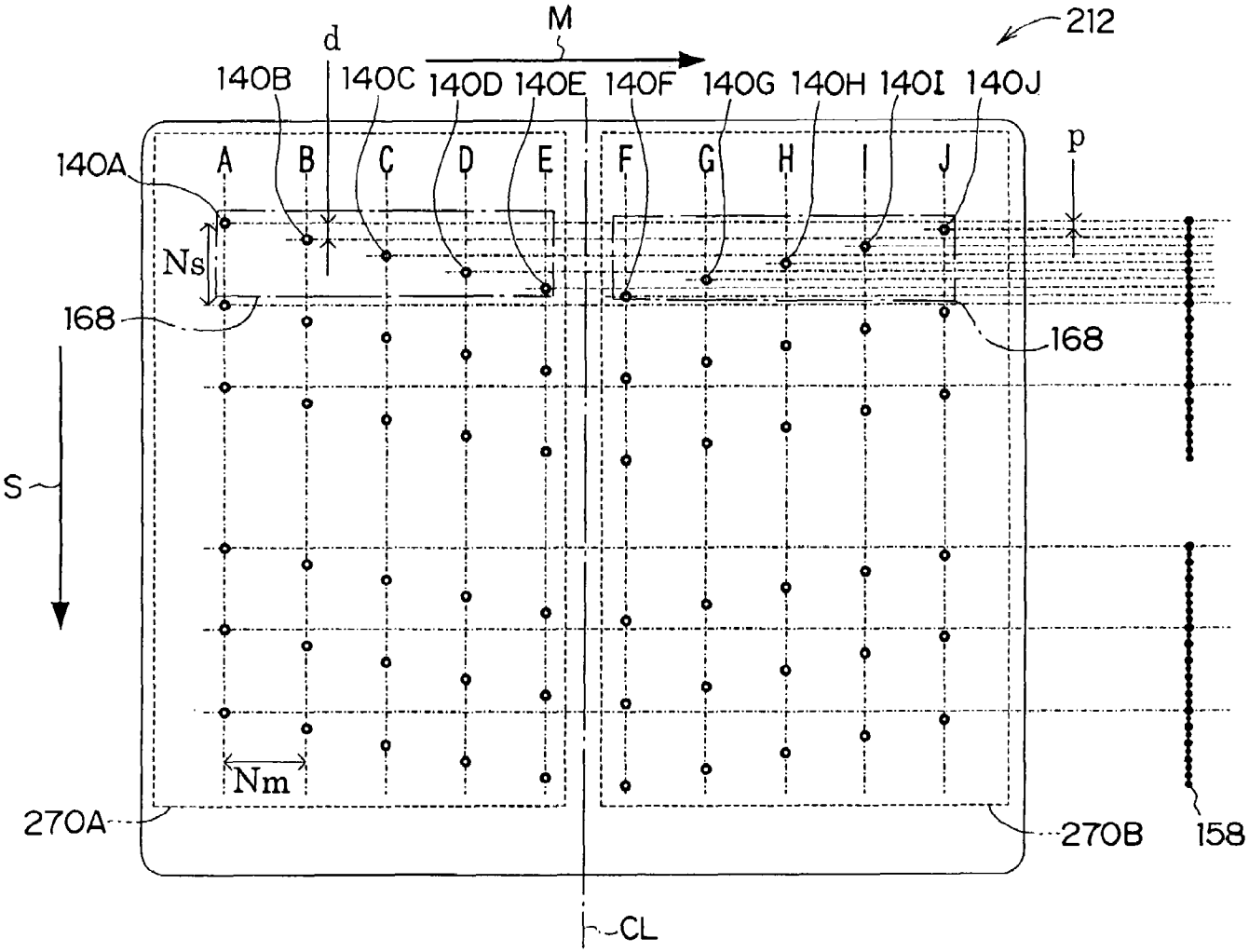
FIG. 14A is a plan view schematically showing the arrangement of the ejector of the droplet ejecting head according to a second embodiment of the invention.
FIG. 14B is an explanatory view showing the dots formed by the droplets ejected from the droplet ejecting head of FIG. 14A in a manner that the dots are arranged in line in the direction orthogonal to the main scanning direction.

FIG. 14A schematically shows the arrangement of the nozzles 140 in a droplet ejecting head 212 according to a second embodiment of the invention. In the droplet ejecting head 212 of the second embodiment, similarly to the first embodiment, a plurality of nozzles 140 are divided into two ejector blocks 270A and 270B. However, ejector units 168 corresponding to the ejector blocks 270A and 270B are arranged so as to be substantially symmetrical with respect to a centerline CL. As a result, the ejector units 168 are disposed so as to be of a flat and substantially v-shaped form, as a whole. The ejector block 270B is offset by the nozzle pitch p in the sub-scanning direction relative to the ejector block 270A, so that the nozzles 140 having the substantially V-shaped arrangement are arranged with the predetermined nozzle pitch p in the sub-scanning direction, as a whole, in the droplet ejecting head 212.

In the second embodiment, the specific sizes such as the nozzle pitch p and the matrix pitches Nm, Ns may be set in a manner similar to that of the first embodiment. Specifically, as an example, an arrangement is possible in which the nozzle pitch p is 84.67 μm, the total number of nozzles is 220, the number of columns of the matrix is 10, and the these nozzles are divided into the left and right (-hand side) ejector blocks 270A and 270B, each of which block has five columns. The right ejector block 270B may be relatively offset from the left ejector block 270A in the sub-scanning direction. More specifically, the right ejector block 270B may be located at the lower position by the nozzle pitch p than the left ejector block 270A. The matrix pitches Nm and Ns may also be set at the same values as the first embodiment. In the above-described arrangement, recording with the nozzle pitch p can be realized such that the ejectors of the ejector blocks 270A and 270B work in a complementary manner, to form a raster.

Figure 15:
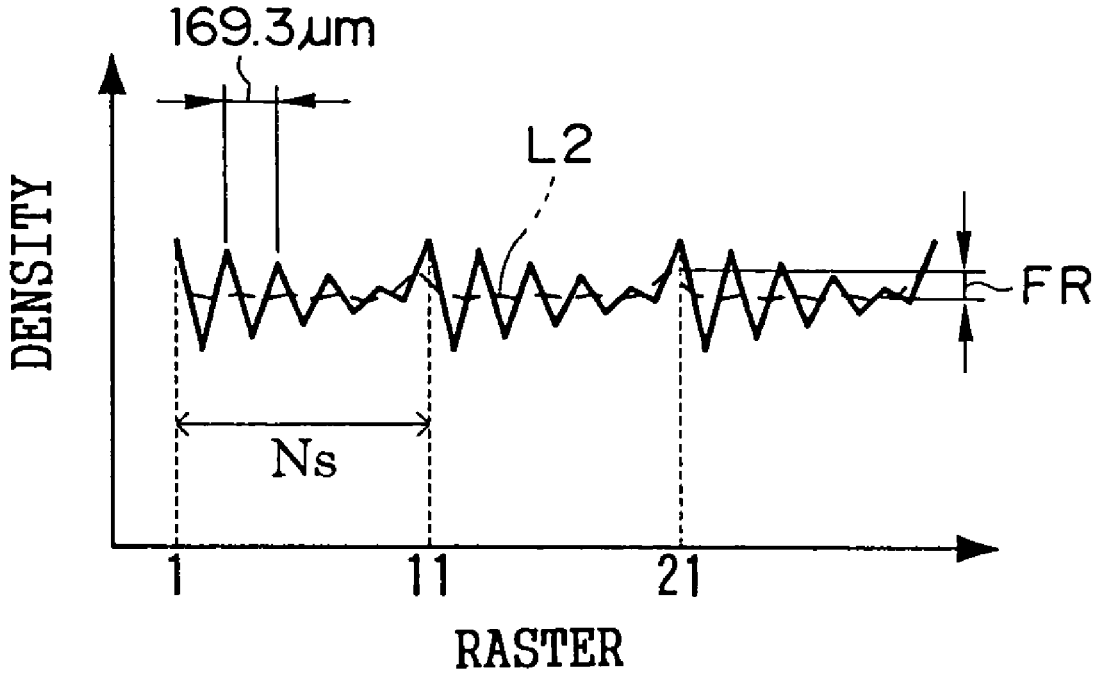
FIG. 15 is a graph showing the relationship between the raster and the density in the droplet ejecting head according to the second embodiment of the invention.

FIGS. 14B and 15 show the raster (the line of the dots 158) and the density in the sub-scanning direction of the image recorded by using the droplet ejecting head 212 of the second embodiment. It is confirmed from these results that the density is made uniform, as in the first embodiment. In the case where the droplet ejecting head 212 has the above-mentioned specific configuration, the density is changed in a fluctuating manner, with the cycle of 169.3 μm, as shown in FIG. 15. However, the cycle is so short that the fluctuation in the density is hardly perceived by human eyes.

In FIG. 15, an average of movements is calculated for two adjacent dots, so that a plot in which the small fluctuations have been eliminated is indicated by a broken line L2. In the matrix-like nozzle arrangement of the second embodiment, it is confirmed that the fluctuation in the density of the cycle of the matrix pitch Ns has substantially been eliminated (see the fluctuation range FR).

In the first and second embodiments, examples in which the plurality of ejectors are divided into two ejector blocks have been cited. However, it is also possible to divide the plurality of ejectors into three or more ejector blocks. In this case, when the number of divided ejector blocks is set at k (k is a natural number more than one), the nozzles 140 may be arranged by deciding d which satisfies d=p×k.

Also, the number of ejectors 138 (nozzles 140) constituting one ejector unit is not limited, and the number of ejectors 138 can be set at n (n is a natural number more than one). There is a relationship of $M_L/k=n$ between the number of columns of the matrix $M_L$, the above-mentioned k and n. Accordingly, each numerical value $M_L$, k, n can be determined within a range which satisfies the above-described relationship. The number of columns $M_L$ is generally set at a value no larger than 20 or so. For example, when the number of divided ejector blocks is set at k=2 in a configuration in which the number of columns is set at $M_L=20$, n is 10. As mentioned below, the number (k) of divided ejector blocks may be three or more. For example, if k=10 in a configuration in which the number of columns is set at $M_L=20$, n is then 2. Accordingly, the range of n will generally be in a range of 2 to 10. However, needless to say, n is not limited to the above range.

Figures 16A, 16B:
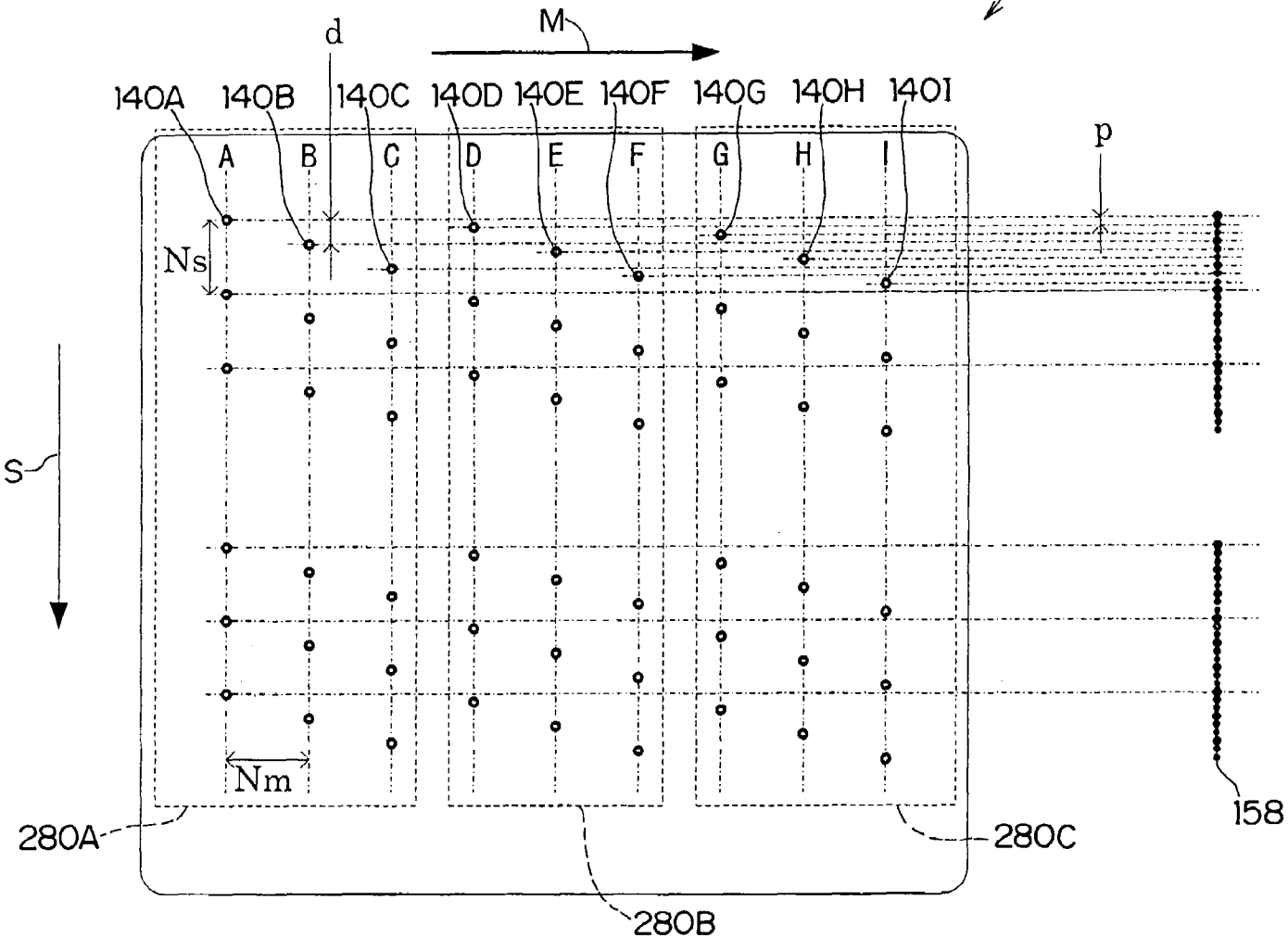
FIG. 16A is a plan view schematically showing the arrangement of the ejector of the droplet ejecting head according to a modification of the second embodiment of the invention.
FIG. 16B is an explanatory view showing the dots formed by the droplets ejected from the droplet ejecting head of FIG. 16A in a manner that the dots are arranged in line in the direction orthogonal to the main scanning direction.

FIG. 16A shows a droplet ejecting head 262 as a modification of the first embodiment, having a configuration in which the number of divided ejector blocks k is set at 3. In the droplet ejecting head 262, the number of columns $M_L$ is set at 9 (therefore, n=3) and the plurality of nozzles 140 (140A to 140I) are uniformly divided along the column direction into the k (k=3) ejector blocks 280A, 280B, and 280C. The nozzles 140A to 140C, 140D to 140F, and 140G to 140I constituting each of the ejector blocks 280A, 280B, and 280C are arranged to be each offset by k times (in this case, three times because of k=3) as much as the desired nozzle pitch in the main scanning direction. Further, the ejector block 280B is arranged to be offset by the nozzle pitch p toward the downstream side in the sub-scanning direction relative to the ejector block 280A, and the ejector block 280C is arranged to be similarly offset by the nozzle pitch p toward the downstream side in the sub-scanning direction relative to the ejector block 280B. Accordingly, in this modified example, when the nozzles 140 are viewed in order in the sub-scanning direction, a droplet is ejected in the order of the nozzles 140A-140D-140G-140B-140E-140H-140C-140F-140I and the dots are arranged in line in the sub-scanning direction. In this example, the specific sizes such as the nozzle pitch p, the matrix pitches Nm and Ns may be set in a manner similar to that of the first embodiment.

Figure 17:
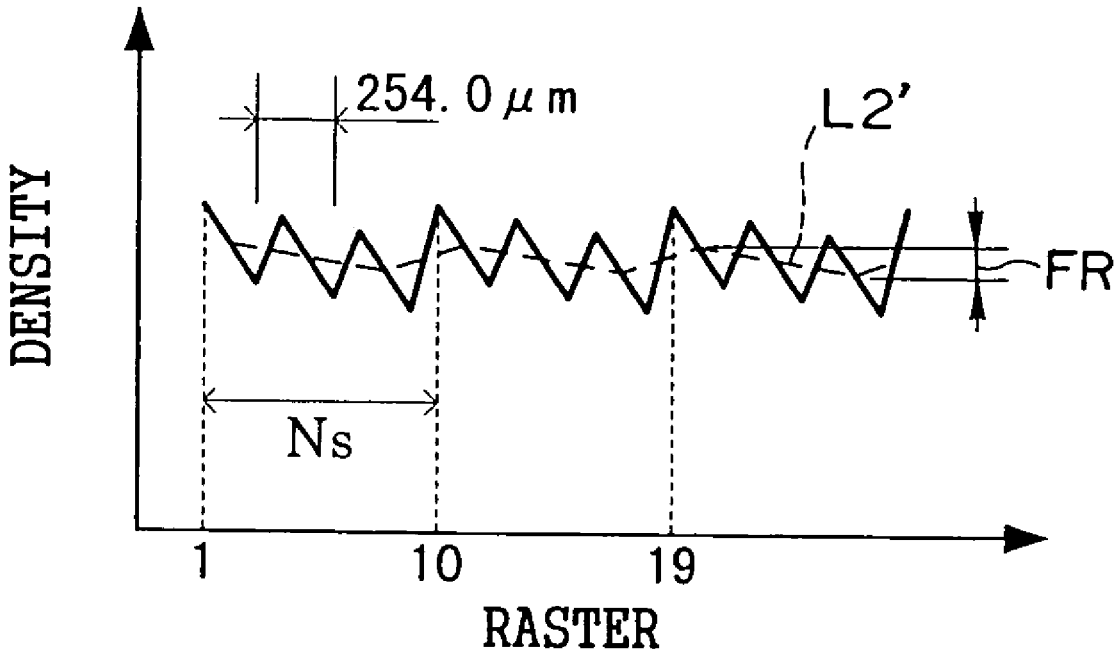
FIG. 17 is a graph showing the relationship between the raster and the density in the droplet ejecting head according to the modification of the second embodiment of the invention.

FIGS. 16B and 17 show the raster (the line of the dots 158) and the density in the sub-scanning direction, respectively, of the image recorded by using the droplet ejecting head 262 of the modification of the first embodiment. It is confirmed from these results that the density is made uniform, as in the first embodiment. In a case in which the specific sizes such as the nozzle pitch p, the matrix pitches Nm and Ns are set at the values similar to those of the first embodiment, the density is changed in a fluctuating manner with the cycle of 245.0 μm, as shown in FIG. 17. However, the cycle is so short that the fluctuation in the density is hardly perceived by human eyes.

In FIG. 17, an average of movements is calculated for two adjacent dots, so that a plot in which small fluctuations have been eliminated is indicated by a broken line L2'. In the matrix-like nozzle arrangement of a modification of the first embodiment, it is confirmed that the fluctuation in the density of a cycle of the matrix pitch Ns has substantially been eliminated (see the fluctuation range FR).

In the examples shown in FIGS. 16A, 16B, and 17, the ejector block 280C may be offset by the nozzle pitch p toward the downstream side in the sub-scanning direction relative to the ejector block 280A, and the ejector block 280B may be offset by the nozzle pitch p toward the downstream side in the sub-scanning direction relative to the ejector block 280C. In this configuration, when the nozzles 140 are viewed in order in the sub-scanning direction, a droplet is ejected in the order of the nozzles 140A-140G-140D-140B-140H-140E-140C-140I-140F and the dots are arranged in line in the sub-scanning direction.

[Third Embodiment]

Figures 18A, 18B:
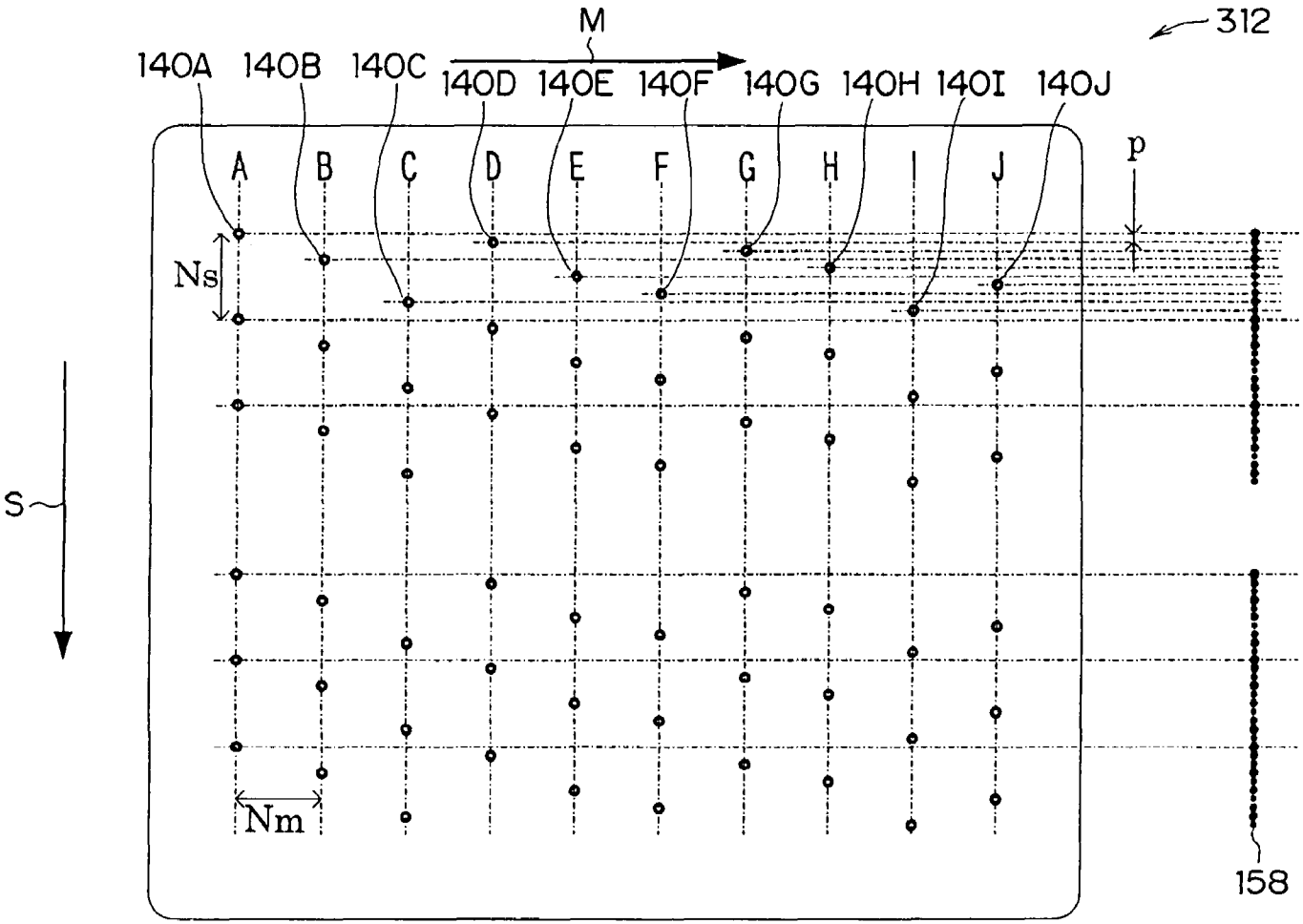
FIG. 18A is a plan view schematically showing the arrangement of the ejector of the droplet ejecting head according to a third embodiment of the invention.
FIG. 18B is an explanatory view showing the dots formed by the droplets ejected from the droplet ejecting head of FIG. 18A in a manner that the dots are arranged in line in the direction orthogonal to the main scanning direction.

FIG. 18A schematically shows an arrangement of the nozzles 140 in a droplet ejecting head 312 according to a third embodiment of the invention. In the droplet ejecting head 312 of the third embodiment, the cyclic change in dot size/raster density is suppressed, without dividing the plurality of nozzles 140 into ejector blocks. Specifically, when the nozzles 140 (ejectors 138) are viewed in order in the sub-scanning direction, the nozzles 140 are arranged such that droplets are ejected in the order of the nozzles, for example, 140A-140D-140G-140B-140H-140E-140J-140F-140C-140I and these dots are arranged in line in the sub-scanning direction.

In the arrangement of the nozzles 140 of the third embodiment, two nozzles 140 adjacent to each other in the main scanning direction, e.g., the nozzles 140A and 140B, are prevented from recording adjacent rasters, so that the fluctuation in the density for adjacent rasters is not small. Further, when two nozzles 140 relatively distanced from each other in the main scanning direction, e.g., the nozzles 140A and 140J, record adjacent rasters, a fluctuation in density which is large enough to be perceived may be generated. Therefore, in the present embodiment, such distanced nozzles as 140A and 140J are also prevented from recording adjacent rasters.

In the third embodiment, the specific sizes such as the nozzle pitch p and the matrix pitches Nm, Ns may be set in a manner similar to that in the first embodiment. Specifically, as an example, an arrangement is possible in which the nozzle pitch p is 84.67 μm, the total number of nozzles is 220 and the number of columns of the matrix is 10. In this case, since the nozzles are disposed according to the same patterns in all the rows of the matrix (i.e., in each unit including ten nozzles 140 from the nozzle 140A to the nozzle 140J in the example shown in FIG. 18A), the matrix pitch Ns in the sub-scanning direction is constant throughout the rows.

Figure 19:
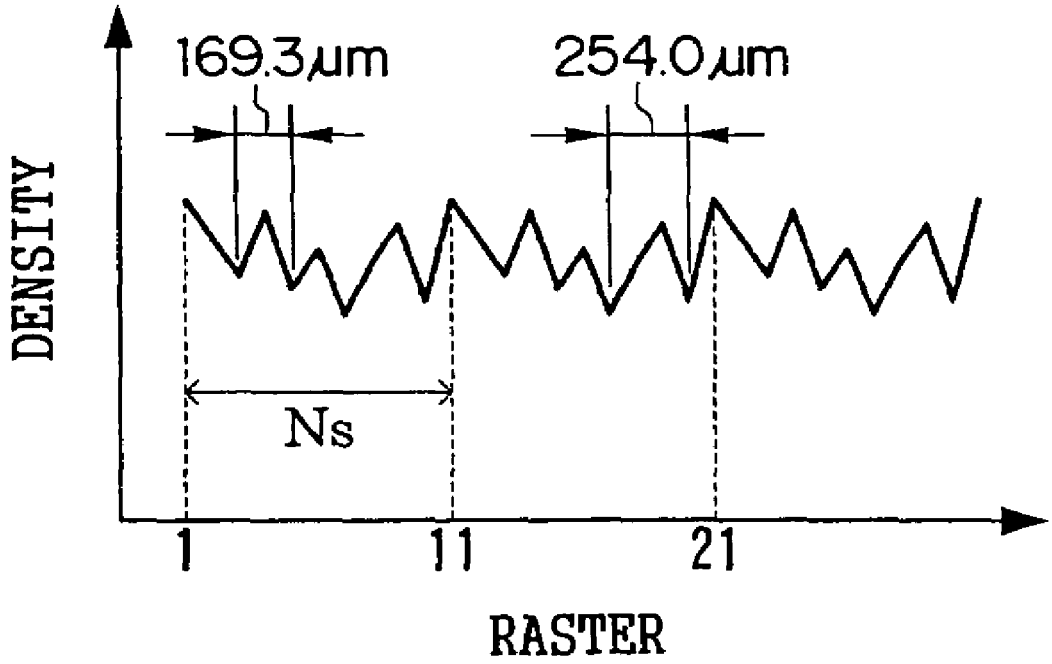
FIG. 19 is a graph showing the relationship between the raster and the density in the droplet ejecting head according to the third embodiment of the invention.

FIGS. 18B and 19 show the raster (the line of the dots 158) and the density in the sub-scanning direction, respectively, of the image recorded by using the droplet ejecting head 312 of the third embodiment. It is confirmed from these results that the density is made uniform, as in the first embodiment. In the case where the droplet ejecting head 312 has the above-described specific configuration, two cycles of 169.3 μm and 254.0 μm appear in the fluctuating changes in density, as shown in FIG. 19. However, even the longer cycle of 254.0 μm, of the fluctuating change in density, is too short to be perceived by human eyes. Thus, in this case, the fluctuation in density is hardly recognizable for human eyes.

Figure 29:
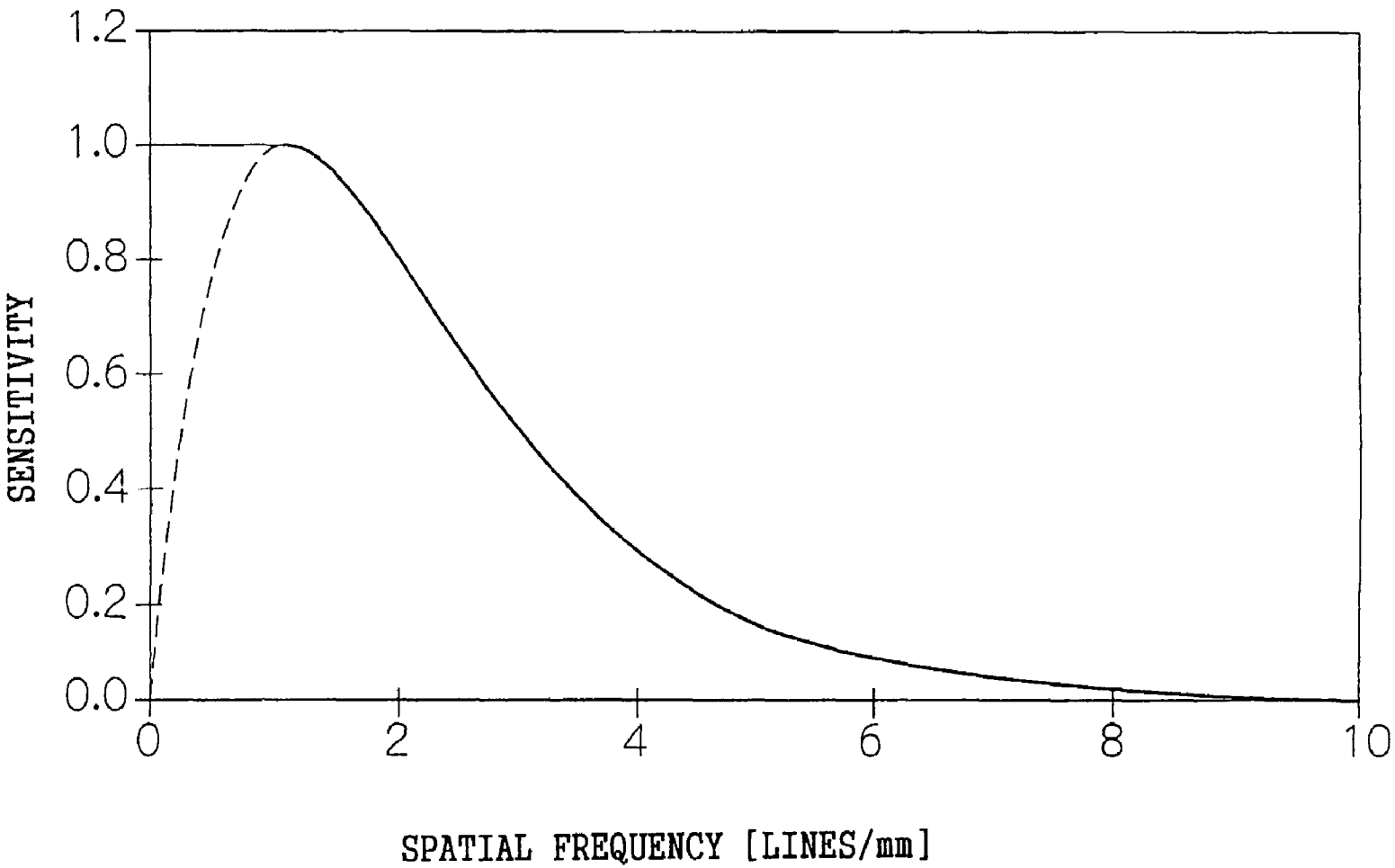
FIG. 29 is a graph showing human visual sensitivity for density unevenness, with the horizontal axis indicating a spatial frequency.

With reference to the sensitivity of human eyes shown in FIG. 29, it is understood that the shorter the cycle of fluctuation of change in density, the less recognizable the changes are for human eyes. Therefore, a droplet ejecting head 362 of a modified type, having the matrix-like nozzle arrangement shown in FIG. 20A, can be produced by further shortening the cycle of offset in the matrix-like nozzle arrangement of FIG. 18A. Specifically, in the matrix-like nozzle arrangement shown in FIG. 20A, when the nozzles 140 (ejectors 138) are viewed in order in the sub-scanning direction, the nozzles 140 are arranged such that droplets are ejected in the order of the nozzles 140A-140F-140C-140H-140E-140J-140D-140I-140B-140G and the dots are aligned in the sub-scanning direction.

Figures 20A, 20B:
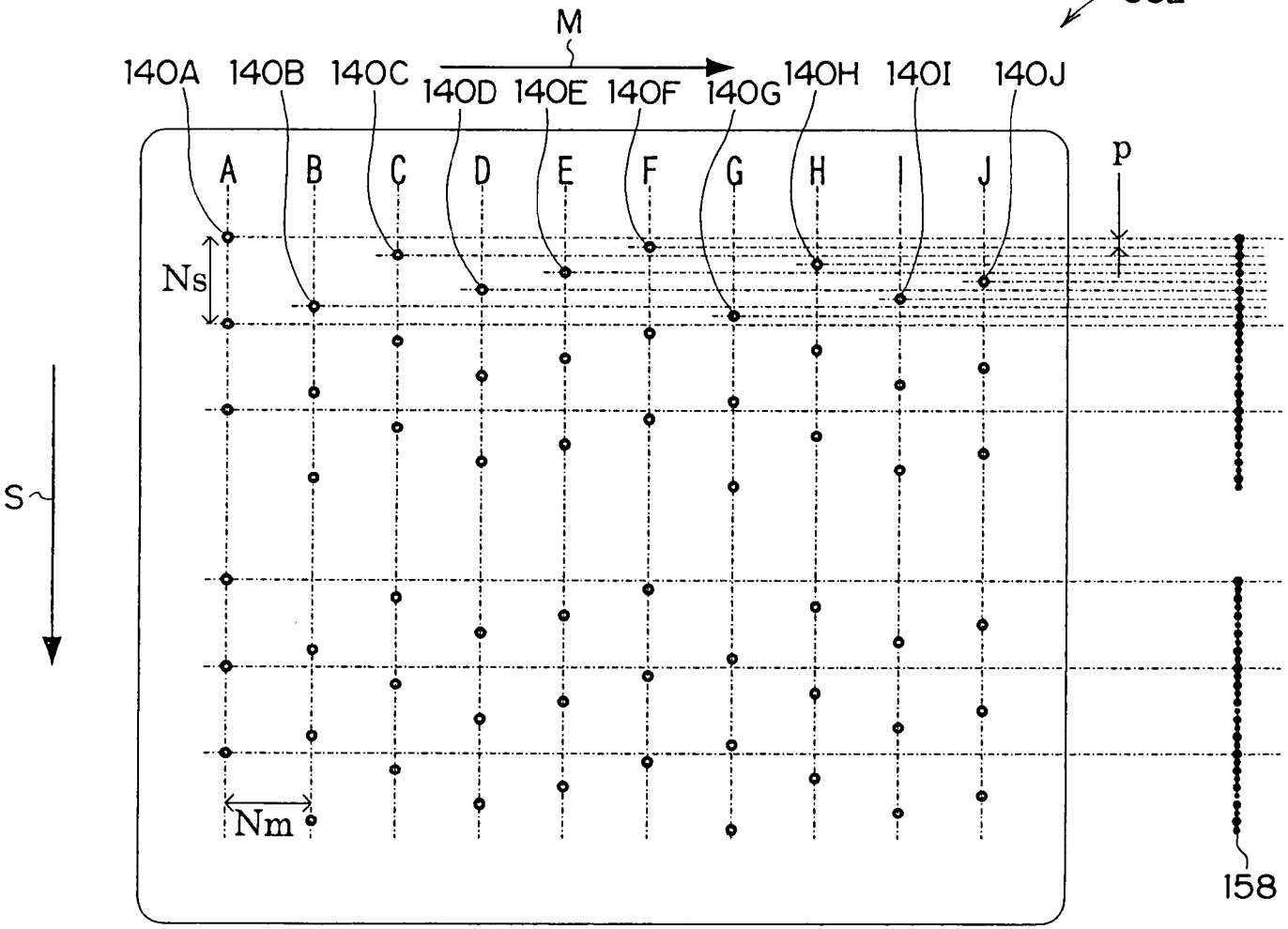
FIG. 20A is a plan view schematically showing the arrangement of the ejector of the droplet ejecting head according to a modification of the third embodiment of the invention.
FIG. 20B is an explanatory view showing the dots formed by the droplets ejected from the droplet ejecting head of FIG. 20A in a manner that the dots are arranged in line in the direction orthogonal to the main scanning direction.
Figure 21:
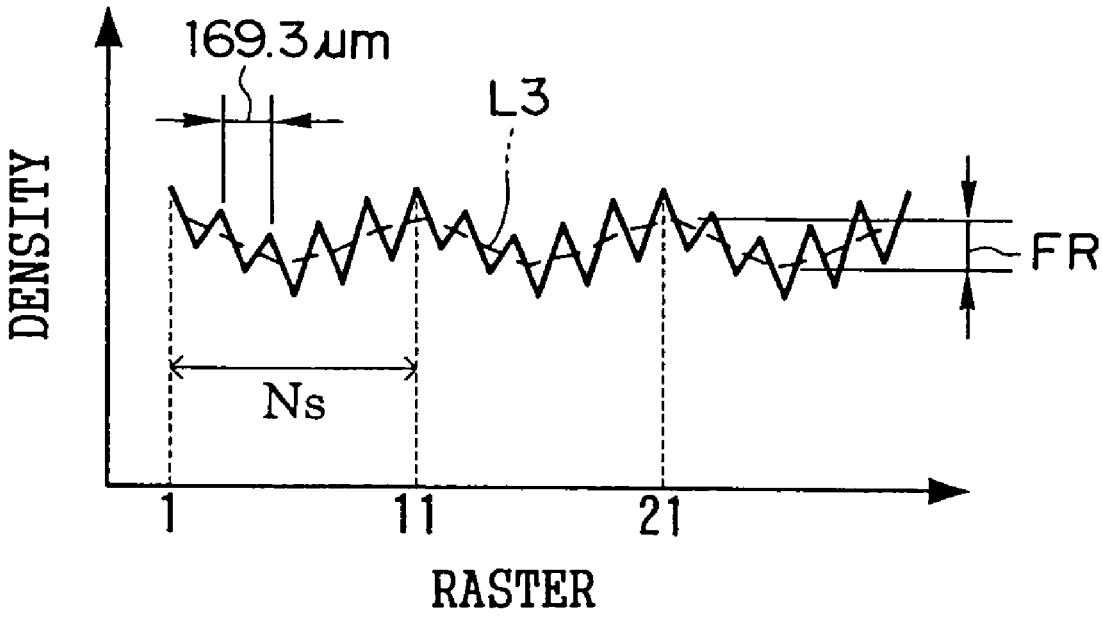
FIG. 21 is a graph showing the relationship between the raster and the density in the droplet ejecting head according to the modification of the third embodiment of the invention.

FIGS. 20B and 21 show the raster (the line of the dots 158) and the density in the sub-scanning direction, respectively, of the image recorded by using the droplet ejecting head 362. It is confirmed from these results that the density is made uniform, as in the first embodiment. In the droplet ejecting head 362, the cycle of the fluctuating change in density is only 169.3 μm, and thus the fluctuating changes in density thereof is further more difficult to perceive than those of the droplet ejecting head 312 having the matrix-like nozzle arrangement shown in FIG. 18A.

In FIG. 21, similarly to FIG. 19, an average of movements is calculated for adjacent two dots, so that a plot in which small fluctuations have been eliminated is indicated by a broken line L3. In the matrix-like nozzle arrangement of a modification of the third embodiment, i.e., the droplet ejecting head 362, the fluctuation in density of the cycle of the matrix pitch Ns is excellently moderate and thus the uniformity of the density is better, as compared with the first embodiment. Further, in the droplet ejecting head 362, the problem of the unevenness in the fluctuating changes in density, observed in the second embodiment, is solved.

As described above, the shorter the cycle of fluctuating changes in density, the less recognizable the changes are for human eyes. It should be noted that realization of a short cycle of fluctuating changes is restricted by the nozzle pitch p and thus the shortest cycle is nozzle pitch×2 (namely d). In recent years, the nozzle density of the inkjet recording apparatus has been remarkably increased, and an inkjet recording head having the nozzle density of about 20000 NPI (nozzle number per inch) will be realized in future at low cost, achieving sufficiently high resolution in practical terms. The invention can be applied to such an inkjet recording head having the nozzle density of about 20000 NPI and, in this case, the nozzle pitch is 1.27 μm. Accordingly, it can be assume that an inkjet recording head having high resolution will be realized at low cost in future, such that the cycle of the fluctuating changes in density is approximately 2.5 μm. Therefore, it is concluded that the preferred range of a cycle of the fluctuating changes in density in the present invention is from 2.5 to 254 μm.

[Fourth Embodiment]

Figures 22A, 22B:
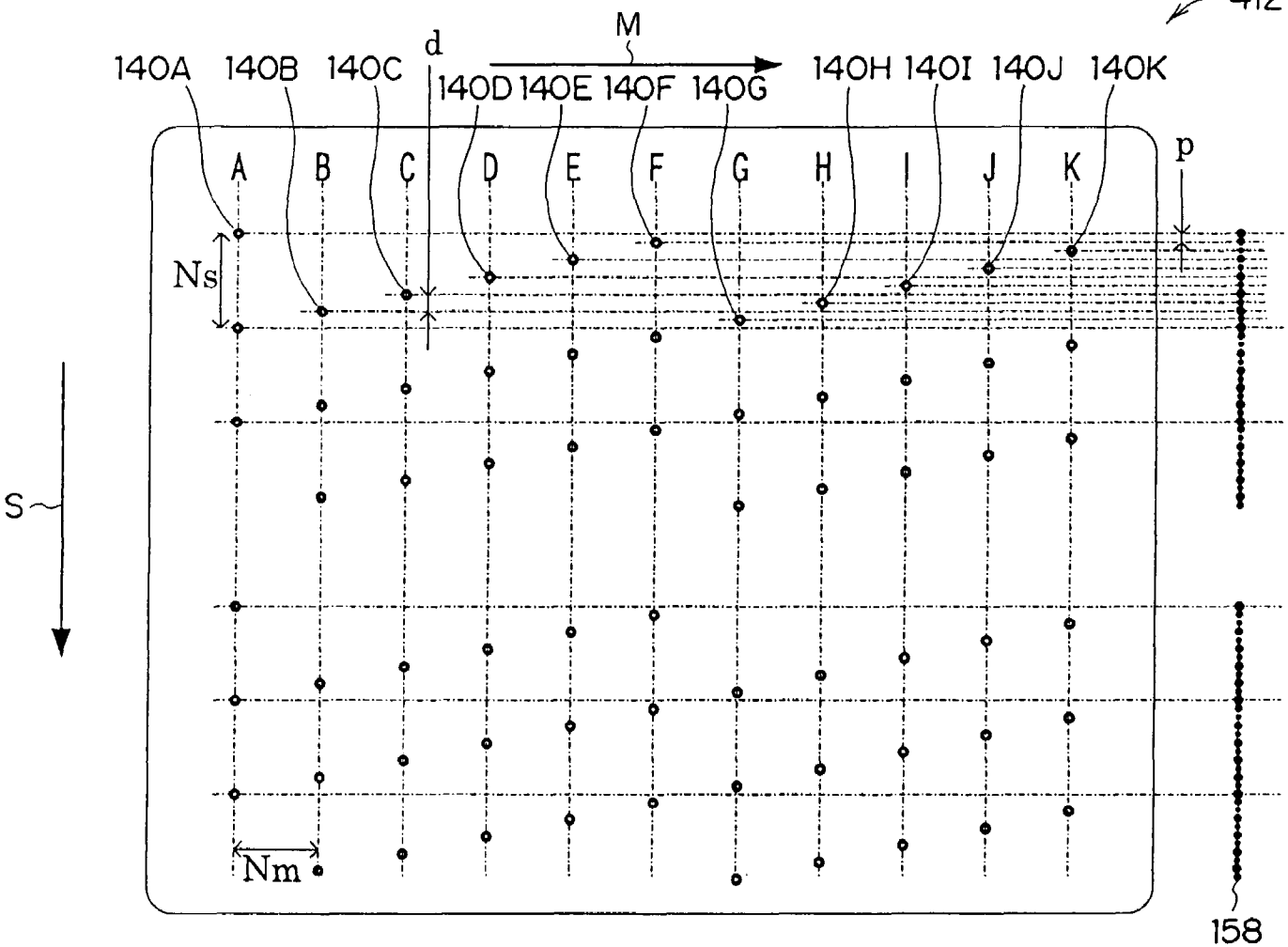
FIG. 22A is a plan view schematically showing the arrangement of the ejector of the droplet ejecting head according to a fourth embodiment of the invention.
FIG. 22B is an explanatory view showing the dots formed by the droplets ejected from the droplet ejecting head of FIG. 22A in a manner that the dots are arranged in line in the direction orthogonal to the main scanning direction.

FIG. 22A schematically shows an arrangement of the nozzles 140 in a droplet ejecting head 412 according to a fourth embodiment of the invention. The droplet ejecting head 412 of the present embodiment has eleven columns of the matrix, to which the present invention is applied. Specifically, when the nozzles 140 (ejectors 138) are viewed in order in the sub-scanning direction, the nozzles 140 are arranged such that droplets are ejected in the order of the nozzles, e.g. 140A-140F-140K-140E-140J-140D-140I-140C-140H-140B-140G and the dots are aligned in line in the sub-scanning direction. The nozzles 140 adjacent to each other in the main scanning direction (for example, nozzles 140B and 140C or nozzles 140C and 140D) are offset by two times as much as the nozzle pitch p in the sub-scanning direction, and a lattice has a rhombus shape.

When the nozzle arrangement in the fourth embodiment is locally viewed, the nozzle arrangement in the fourth embodiment is the same as that in one of the ejector blocks 170A and 170B in the first embodiment. However, in the present embodiment, it is not necessary to divide the ejectors as a whole into two ejector blocks.

In the fourth embodiment, the nozzles adjacent to each other in the main scanning direction are offset by two times as much as the nozzle pitch p in the sub-scanning direction. The raster located between these adjacent nozzles will be recorded by a nozzle which belongs to the adjacent column. In the present embodiment, since it is not necessary to divide the ejectors as a whole into two ejector blocks, the nozzles can be arranged in a relatively regular manner. This feature that the arrangement of the nozzles is relatively regular is advantageous in terms of densely arranging the components such as the pressure chamber and the piezoelectric element. The number of the columns is eleven in the present embodiment. However, as long as the number of columns is an odd number, arranging matrix nozzles such that the positions thereof in the main scanning direction alternate in an offsetting manner can be made compatible with making the nozzle arrangement regular. For example, the same effect as described above can be obtained when the number of the column is 9 or so.

Figure 23:
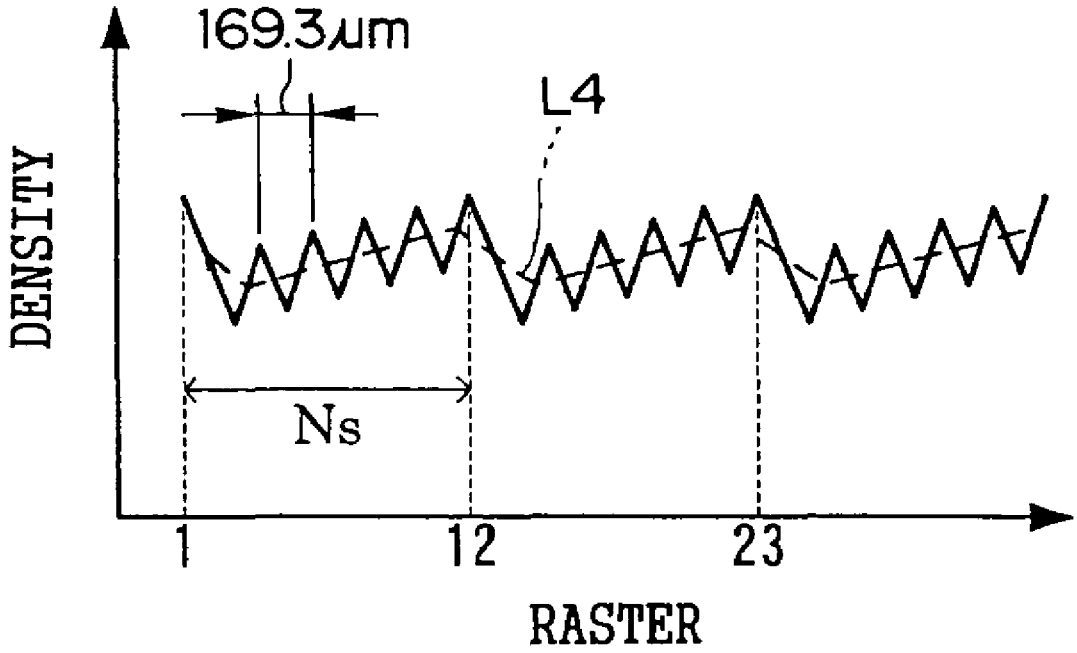
FIG. 23 is a graph showing the relationship between the raster and the density in the droplet ejecting head according to the fourth embodiment of the invention.
Figure 24:
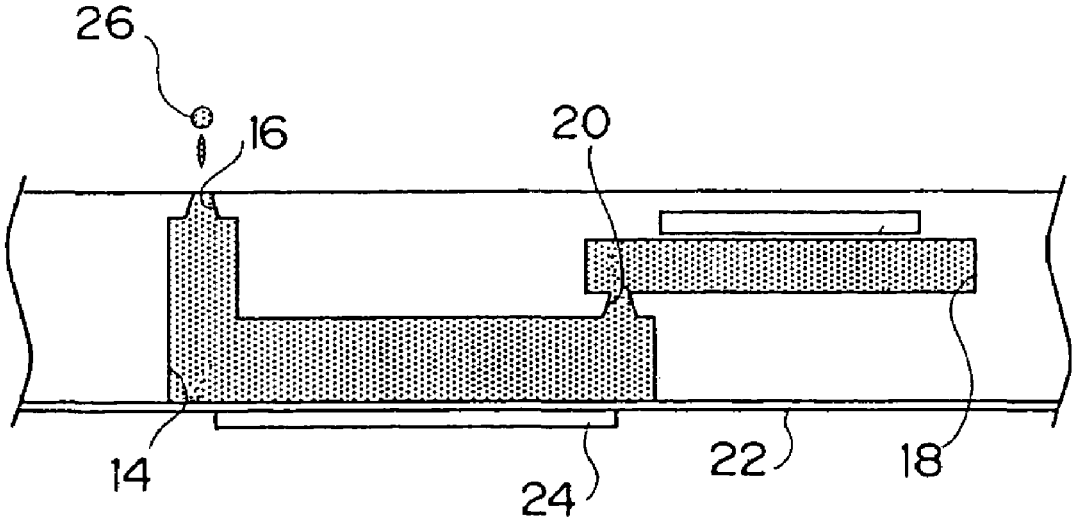
FIG. 24 is a sectional view showing a structure of the conventional droplet ejecting head.
Figure 25:
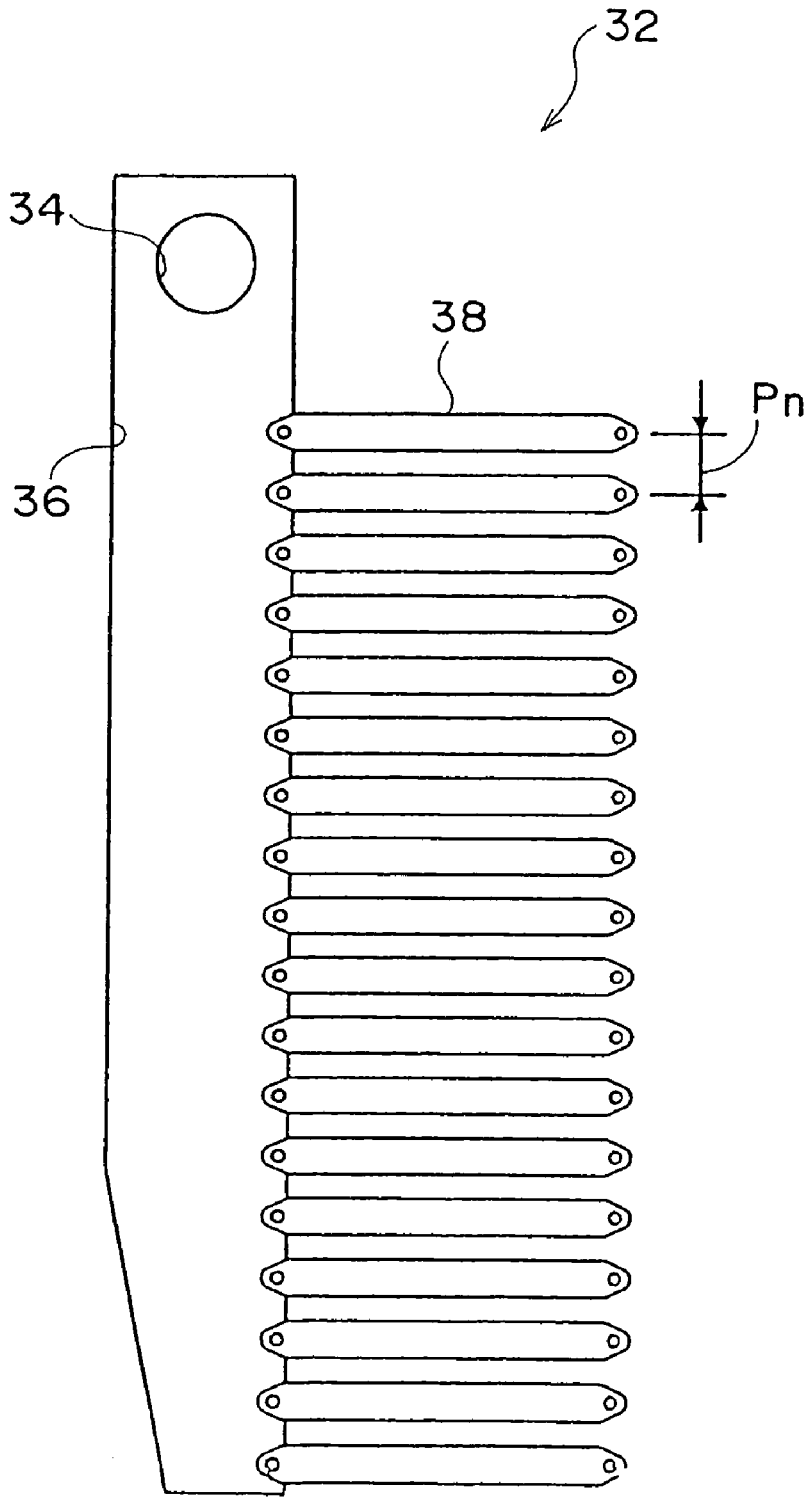
FIG. 25 is a plan view schematically showing the arrangement of the ejectors of the conventional droplet ejecting head having a linear nozzle arrangement.

FIGS. 22B and 23 show the raster (the line of the dots 158) and the density in the sub-scanning direction, respectively, of the image recorded by using the droplet ejecting head 412. It is confirmed from these results that the density is made uniform, as in the first embodiment. Further, in the droplet ejecting head 412, the cyclic of the fluctuating change in density is 169.3 μm, which is too short to be perceived by human eyes.

In FIG. 23, similarly to FIGS. 15 and 21, an average of movements is calculated for two adjacent dots, so that a plot in which small fluctuations have been eliminated is indicated by a broken line L4. In the matrix-like nozzle arrangement of the fourth embodiment, the fluctuation in the density having a cycle of the matrix pitch Ns is improved as well as the first embodiment.

For example, in the nozzle arrangement of the fourth embodiment, when the 220 nozzles are arranged in the form of the matrix with the nozzle pitch of 84.67 μm, the matrix pitch Nm in the main scanning direction is 846.7 μm (ten times as much as the nozzle pitch p) and the matrix pitch Ns in the sub-scanning direction is 931.3 μm (eleven times as much as the nozzle pitch p).

In the aforementioned description, each of the embodiments of the invention have been described. However, each of these embodiments simply demonstrates one of the preferable modes of the invention, and the invention is not limited to these embodiments. The above-described embodiments may be subjected to various modifications, improvements, corrections, and simplifications, without departing from the spirit of the invention.

For example, although the aforementioned embodiments have the configurations in which a droplet is ejected by the pressure generated by the deformation of the piezoelectric actuator, energy for ejecting a droplet may be obtained by the use of another pressure generating means such as an electromechanical transducer utilizing electrostatic force/magnetic force or an electrothermal transducer for utilizing a boiling phenomenon to generate a pressure. For the piezoelectric actuator, other type actuators such as a laminated type piezoelectric actuator causing longitudinal vibration may be used instead of the single plate type piezoelectric actuator used in the aforementioned embodiment. Further, the invention may adopt a configuration in which the energy for ejecting a droplet is obtained from thermal energy and the like.

Although the channel is formed by laminating the plurality of plates in the aforementioned embodiments, the configuration and the material of the plates are not limited to those of the embodiments. For example, the present invention is also applicable to a head in which the channel is integrally formed by using materials such as ceramics, glass, resin, and silicon.

Although the pressure generating chamber 142 has a quadrangular shape in the embodiments, the pressure generating chamber may have other shapes such as a circle, a hexagon, and a rectangle. Further, although the shapes of the pressure generating chambers are the same in the entire head in the aforementioned embodiments, the pressure generating chambers having the different shapes may be mixed in the head.

Although the aforementioned embodiments have the configurations in which the second channel 132 is arranged along the main scanning direction, while the common channel 136 is arranged along the sub-scanning direction, the arrangement of the common channel 136 and the second common channel 132 is not limited to the above configurations, as long as the ink can be reliably supplied to the pressure generating chamber 142. For example, the common channel may be arranged along the main scanning direction and the second common channel may be arranged along the sub-scanning direction.

It is not necessary that the same method of arranging the ejectors is employed for all the common channels. It is acceptable that a different method of arranging the ejectors is employed for each common channel.

Although the common channel and the second common channel are incorporated in the laminated channel plate 114 in the aforementioned embodiments, the structures of the common channel and the second common channel are not limited to those of the embodiments. Other channel structures, for example, a structure in which the ink feed apparatus is directly connected to the laminated channel plate 114, without forming the second common channel inside the laminated channel plate 114, so that the ink feed apparatus itself has a function as the second common channel, may be used.

Further, the invention may have a configuration in which the second common channel 132 is omitted in the laminated channel plate 114 and the ink feed aperture 134 and the ejectors 138 are each directly connected by way of an individual channel.

The aforementioned embodiments disclosed, as examples, the inkjet recording head and the inkjet recording apparatus, which eject a droplet of the colored ink (ink droplet) on the recording paper P, to record characters and images. However, the droplet ejecting head and the droplet ejecting apparatus of the invention are not limited to such an inkjet recording head and inkjet recording apparatus, which record characters and images on the recording paper. Further, the recording medium is not necessarily limited to the paper, and the ejected liquid is not necessarily limited to the colored ink. The droplet ejecting head and droplet ejecting apparatus of the invention can generally be applied to a droplet injecting apparatus for various industrial applications such as producing a color filter for display by ejecting colored ink on an organic film or glass, forming a bump for mounting a member by ejecting melted solder on a board, forming an EL display panel by ejecting organic EL solution on a substrate, and forming a bump for the electrical mounting by ejecting melted solder on the board.

In the aforementioned embodiments, the mode in which a droplet is ejected, while the droplet ejecting head is moved by the carriage, has been employed. However, the present invention can be applied to another apparatus mode, in which a line type droplet ejecting head in which the ink ejecting openings 152 are arranged in the overall width of the recording medium is used, the line type head is fixed and the recording is performed while only the recording medium is fed (only the main scanning is performed in this case).

As the present invention has the above-described configurations, the density unevenness which tends to be generated in a head having a matrix-like nozzle arrangement can be decreased without decreasing the recording speed. Accordingly, high-speed recording can be made compatible with high-quality recording.

What is claimed is:

1. A droplet ejecting head in which a plurality of ejectors for ejecting a droplet are two-dimensionally arranged and the droplet is ejected while the droplet ejecting head is moved in a main scanning direction relative to a recording medium, characterized in that:

the ejectors are arranged such that, when the ejectors are viewed in order in the main scanning-orthogonal direction, which is orthogonal to the main scanning direction, positions of the ejectors in the main scanning direction alternate in an offsetting manner, such that sizes of dot diameters of droplets from the plurality of ejectors is changed at random, wherein the ejectors are divided, in the main scanning direction, into k (k is a natural number more than one) ejector blocks, each ejector block includes at least one ejector unit disposed in the main scanning-orthogonal direction, each ejector unit includes n (n is a natural number more than one) ejectors adjacent in the main scanning direction, wherein each of the ejectors has a nozzle pitch p, and the ejectors of each ejector unit are offset from each other in the main scanning-orthogonal direction, by a desired pitch p×k, and wherein there is a relationship $M_L/k=n$ between a total number of columns $M_L$ of the ejectors, k and n.

2. A droplet ejecting head according to claim 1, wherein a spatial frequency of offsetting alternation of the position of the ejector in the main scanning direction is in a range of 2.5 μm to 254 μm (inclusive of both 2.5 μm and 254 μm).

3. A droplet ejecting head according to claim 1, wherein the offsetting alternation of the position of the ejector in the main scanning direction occurs at each ejector.

4. A droplet ejecting head according to claim 1, wherein one ejector unit of one ejector block is offset, by the nozzle pitch p, in the main scanning-orthogonal direction, relative to a main scanning direction-adjacent ejector unit of another ejector block which is adjacent to the one ejector block in the main scanning direction.

5. A droplet ejecting head according to claim 4, wherein a configuration of the ejector units of one ejector block and a configuration of the ejector units of another ejector block which is adjacent to the one ejector block are symmetrical, with respect to a centerline between the ejector blocks.

6. A droplet ejecting head according to claim 1, wherein the n is an odd number.

7. A droplet ejecting head characterized by having a droplet ejecting head described in claim 1.

8. A droplet ejecting head which ejects a droplet while being moved in a main scanning direction relative to a recording medium, including:

a plurality of ejectors which are two-dimensionally arranged, to eject a droplet, wherein the plurality of ejectors are arranged such that, when the ejectors are viewed in order in a main scanning-orthogonal direction, which is orthogonal to the main scanning direction, two ejectors adjacent in the main scanning direction is prevented from being adjacent in the main scanning-orthogonal direction, and a spatial frequency of offsetting alternation of the positions of the ejectors in the main scanning direction is in a range of 2.5 μm to 254 μm (inclusive of both 2.5 μm and 254 μm);

wherein the ejectors are arranged such that, when dots of the droplets ejected on the recording medium are viewed in a main scanning-orthogonal direction, the sizes of dot diameters are changed at random, wherein the ejectors are divided, in the main scanning direction, into k (k is a natural number more than one) ejector blocks, each ejector block includes at least one ejector unit disposed in the main scanning-orthogonal direction, each ejector unit includes n (n is a natural number more than one) ejectors adjacent in the main scanning direction, the ejectors of each ejector unit are offset from each other in the main scanning-orthogonal direction, wherein each of the ejectors has a nozzle pitch p, and by a desired pitch p×k, and wherein there is a relationship $M_L/k=n$ between a total number of columns $M_L$ of the ejectors, k and n.

9. A droplet ejecting head according to claim 8, wherein, in the k ejector units adjacent in the main scanning direction, of the k ejector blocks, one ejector unit of one ejector block is offset, by p, in the main scanning-orthogonal direction, relative to a main scanning direction-adjacent ejector unit of another ejector block which is adjacent to the one ejector block in the main scanning direction.

10. A droplet ejecting head according to claim 9, wherein a configuration of the ejector units of one ejector block and a configuration of the ejector units of another ejector block which is adjacent to the one ejector block are symmetrical, with respect to a centerline between the ejector blocks.

11. A droplet ejecting head according to claim 8, wherein the n is an odd number.

12. A droplet ejecting head according to claim 8, wherein the ejectors are arranged such that, when the dots of the droplets ejected on the recording medium are viewed in the main scanning-orthogonal direction, densities of the dots are fluctuated up and down at each dot.

13. A droplet ejecting head according to claim 8, wherein the ejectors are arranged such that, when the dots of the droplets ejected on the recording medium are viewed in the main scanning-orthogonal direction, densities of the dots are fluctuated up and down at each dot and a cycle of the fluctuation is p×k.

14. A droplet ejecting head characterized by having a droplet ejecting head described in claim 8.

* * * * *